US006382755B1

(12) United States Patent
Imanaka et al.

(10) Patent No.: US 6,382,755 B1
(45) Date of Patent: May 7, 2002

(54) PRINTHEAD AND PRINTING APPARATUS USING PRINTHEAD

(75) Inventors: Yoshiyuki Imanaka, Kawasaki; Teruo Ozaki; Muga Mochizuki, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/399,948

(22) Filed: Sep. 20, 1999

(30) Foreign Application Priority Data

Sep. 21, 1998 (JP) ..... 10-266964

(51) Int. Cl.[7] ..... B41J 29/38; B41J 29/393; B41J 2/05

(52) U.S. Cl. ..... 347/12; 347/19; 347/60

(58) Field of Search ..... 347/12, 13, 19, 347/40, 57, 60

(56) References Cited

U.S. PATENT DOCUMENTS

| | | | | |
|---|---|---|---|---|
| 4,313,124 A | | 1/1982 | Hara | 347/357 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,477,245 A | * | 12/1995 | Fuse | 347/10 |
| 5,497,174 A | * | 3/1996 | Stephany et al. | 347/134 |
| 5,867,200 A | * | 2/1999 | Tajima et al. | 347/211 |
| 6,123,404 A | * | 9/2000 | Tanaka et al. | 347/5 |
| 6,183,056 B1 | * | 2/2001 | Corrigan et al. | 347/14 |
| 6,224,195 B1 | * | 5/2001 | Maru et al. | 347/60 |
| 6,302,509 B1 | * | 10/2001 | Iwasaki et al. | 347/17 |

FOREIGN PATENT DOCUMENTS

| | | | |
|---|---|---|---|
| DE | 28 43 064 | 4/1979 | B41J/3/04 |
| JP | 54-051837 | 4/1979 | B41J/3/04 |
| JP | 54-056847 | 5/1979 | B41M/5/26 |
| JP | 59-123670 | 7/1984 | B41J/3/04 |
| JP | 59-138461 | 8/1984 | B41J/3/04 |
| JP | 60-071260 | 4/1985 | B41J/3/04 |
| JP | 2-508 | 1/1990 | B41J/2/045 |

* cited by examiner

*Primary Examiner*—John Barlow
*Assistant Examiner*—Alfred Dudding
(74) *Attorney, Agent, or Firm*—Fitzpatrick, Cella, Harper & Scinto

(57) ABSTRACT

A printhead with a comparatively simple construction, which contributes to reducing the cost of the entire system and development work, effectively utilizes essential constituent devices of a logic circuit of the printhead such as a shift register, while omitting control on the printing apparatus side, and individually performs stable print operation, while suppressing variation of energy inputted to heat generators due to voltage drop by parasitic resistance. A printing apparatus incorporates the printhead. The printhead has a counter which counts the number of simultaneously-driven heat generators, which always changes in accordance with image data, based on externally-inputted image data and block selection signal, and a modulator which modulates the pulse width of a drive signal applied to the simultaneously-driven heat generators based on a value obtained from counting by the counter.

23 Claims, 20 Drawing Sheets

100
416-(n)
BLKn
416-(3)
BLK3
416-(2)
BLK2
416-(1)
BLK1
414b
414a
415
410
409
406
405
407
412
101-(k)
101-(2)
101-(1)
HTSELk
HTSEL2
HTSEL1
RST
LTCLK
CLK
DATA
404
N-BIT SHIFT REGISTER
N-BIT LATCH CIRCUIT
403
417a
417b
107
m
3
2
1
106
108
402
401
418a
418b
411
413
ADDER
104
COMPARATOR
103
MEMORY
105
HEAT ENABLE SELECTOR
102

PRINTHEAD AND PRINTING APPARATUS USING PRINTHEAD

BACKGROUND OF THE INVENTION

This invention relates to a printhead and a printing apparatus using the printhead, and more particularly, to a printhead which performs printing in accordance with an ink-jet method and a printing apparatus using the printhead.

In ink-jet printing, noise upon printing is very small and negligible, and printing speed is high, further, a print image can be fixed onto a so-called normal paper without special processing. Recently, attention is focused on the ink-jet printing method having these advantages.

Among ink-jet printing methods, a printing method disclosed in Japanese Patent Publication Laid-open No. 54-51837 and DOLS No. 2843064, for example, has a feature different from other ink-jet printing methods in that thermal energy is applied to liquid such as ink so as to obtain a driving force for discharging the liquid.

That is, according to the above printing method disclosed in these publications, printing is performed by causing a state change with sudden volume increase in the liquid acted upon by the thermal energy, then discharging the liquid from an orifice at the end of a printhead by the action based on the state change, as liquid droplets, and attaching the liquid droplets to a print medium.

Especially, according to DOLS No. 2843064, the method is very effectively applied to so-called drop-on-demand printing. Further, the method easily realizes a full-line type printhead having a printing width corresponding to the entire width of a print medium and orifices in a high density. Accordingly, high-resolution and high quality image can be printed at a high speed.

The printhead to which the printing method is applied has orifices to discharge liquid, liquid channels, connected to the orifices, each including a heat action portion to supply thermal energy to liquid, and a substrate having electrothermal transducers (heat generators) to generate the thermal energy.

Recently, the substrate not only holds the plurality of heat generators but also integrates a plurality of drivers to drive the respective heat generators, a logic circuit including a shift register for temporarily storing image data of number of bits corresponding to the number of heat generators, to transfer the image data serially inputted from a printing apparatus to the respective drivers in parallel, a latch circuit which temporarily latches data outputted from the shift register, and the like.

FIG. 16 is a block diagram showing the arrangement of a logic circuit in a conventional printhead having N heat generators (printing elements).

In FIG. 16, reference numeral 400 denotes a circuit board; 401, heat generators; 402, power transistors; 403, an N-bit latch circuit; and 404, an N-bit shift register. Numeral 415 denotes a sensor for monitoring resistance values of the heat generators 401 and the temperature of the circuit board 400 and a heater to maintain the temperature of the circuit board 400. The sensor may be integrated with the heater, or a plurality of sensors and heaters may be packaged. Numerals 405 to 414 and 416 denote input/output pads. Among these input/output pads, the pad 405 is a clock input pad for inputting a clock (CLK) to operate the shift register 404; the pad 406, an image data input pad for serially inputting image data (DATA); the pad 407, a latch input pad for inputting a latch clock (LTCLK) to hold image data in the latch circuit 403; the pad 408, a drive signal input pad for inputting a heat pulse (HEAT) to externally control driving period by turning the power transistors 402 ON to energize the heat generators 401; the pad 409, a drive power input pad for inputting a driving power (3–8V; generally 5V) for the logic circuit; the pad 410, a GND terminal; the pad 411, a heat generator power input pad for inputting power to drive the heat generators 401; the pad 412, a reset input pad for inputting a reset signal (RST) to initialize the latch circuit 403 and the shift register 404; and the pad 413, an HGND terminal for heat generator drive power source.

Further, numerals 414*a* and 414*b* denote an output pad for outputting a monitor signal and an input pad for inputting control signals for sensor drive and drive of the temperature maintaining heater. Further, numerals 416-(1) to 416(n) denote block-selection signal input pads for inputting block selection signals (BLK1 to BLKn) for block selection in time-division drive. In time-division drive, the N heat generators are divided into n blocks, and driven in block units. Numeral 417*a* denotes AND circuits which calculate the logical products of the outputs from the latch circuit 403 and the block selection signals (BLK1 to BLKn); and 417*b*, AND circuits which calculate the logical products of outputs from the AND circuit 417*a* and the heat signal (HEAT).

Numerals 418*a* and 418*b* denote parasitic resistances which occur on the wiring used for driving the heat generators 401.

The drive sequence of the printhead having the above construction is as follows. In the following description, image data (DATA) is binary data where 1 bit corresponds to 1 pixel.

First, the image data (DATA) is serially outputted from a printing apparatus main body to which the printhead is attached, in synchronization with a clock (CLK), then the data is inputted into the shift register 404. Next, the image data (DATA) is temporarily stored in the latch circuit 403, and ON/OFF outputs in correspondence with image data value ("0" or "1") are made from the latch circuit 403.

In this state, when a heat pulse (HEAT) and a block selection signal are inputted, power transistors supplied with ON outputs from the latch circuit 403, corresponding to heat generators in a block selected by the block selection signal, are driven for "ON" period of the input heat pulse (HEAT). Then, an electric current flows through the corresponding heat generators. Thus, the print operation is performed.

Next, the parasitic resistances 418*a* and 418*b* will be described.

It is preferable that the parasitic resistance does not exist, however, actually it cannot be ignored. The example of FIG. 16 shows the parasitic resistances in the logic circuit of the printhead, however, parasitic resistance also exists on a PCB (printed circuit board) within the printhead or a flexible printer cable (FPC) connecting the printhead and the printing apparatus.

In FIG. 16, as the resistances are common to the plurality of heat generators 401, the ratio between the parasitic resistances and the resistance of all the driven heat generators differs dependent on the number of time-divisionally driven heat generators. As a result, the value of a voltage applied to the heat generators (in other words, the value of voltage drop by the parasitic resistances) changes. Accordingly, the voltage applied to both ends of the heat generators changes due to the duty of a pattern to drive the heat generators, which causes variation in energy to the heat generators.

On the other hand, in accordance with the recent tendency of increase in printing speed, a growing number of heat generators are provided in a printhead, and the drive frequency is increasing. In time division drive, the number of simultaneously-driven heat generators is increasing, therefore, the change of voltage drop due to parasitic resistance is not negligible.

Conventionally, some methods to prevent voltage drop have been proposed. One of these methods is to feed-back control a heat pulse (HEAT) to drive heat generators, on the printing apparatus side, so as to change the pulse width based on a pattern for driving the heat generators of the printhead.

More specifically, as shown in FIG. 17A, on the printing apparatus side, a counter 801 counts the number of simultaneously-driven heat generators based on generated image data, then the counted number is stored into a memory 802. A drive pulse generator 803 modulates the pulse width based on the number. Otherwise, as shown in FIG. 17B, the counter 801 provided in the printing apparatus counts the number of bits of serially-transferred image data at each time-division drive, and the drive pulse generator 803 controls the pulse width based on the counted number.

Further, Japanese Patent Publication Laid-open No. 2-508 discloses a technique to count the number of simultaneously-driven heat generators and to control the pulse width.

However, in the conventional art, the shift register and the latch circuit, which have been already provided in the printhead, a circuit to recognize a pattern to drive the heat generators by time-division drive, a counter circuit used for changing the heat pulse width and the like, must be provided on the printing apparatus side. Thus, control on the printing apparatus side is complicated, and the production cost of the apparatus increases.

The complexity of control will be described with reference to FIG. 18.

FIG. 18 shows image data of a character "H" represented as a 16×16 matrix with 16 dots in a printhead scanning direction and 16 dots in direction of nozzle array of the printhead. Generally, image data generated in the printing apparatus main body is sequentially transferred in accordance with the order of numbers allotted to the matrix, from "1" to "256", as shown in FIG. 18. However, when the above data is transferred to the printhead, the order of data transfer is changed in accordance with the construction of the printhead, and the processed data is transferred.

That is, in accordance with the number of nozzles and the printing cycle of the printhead, the order of data transfer is rearranged. As shown in FIG. 18, the transfer order in a case where the number of nozzles of the printhead is "8" is different from that in a case where the number of nozzles is "16".

Further, as described above, the heat generators of the printhead are time-divisionally driven in one printing cycle. Thus, the control is very complicated since factors to be considered include various numbers of nozzles of the printhead, the number of simultaneously-driven blocks, and the number of simultaneously-driven heat generators based on image data, and these factors must be fed back for modulation of the pulse width to drive the printhead.

The complicated control will be considered with the examples of FIGS. 17A and 17B. In FIG. 17A, calculation processing is complicated since image data to be subjected to counting dynamically changes in accordance with the construction of the printhead such as the number of nozzles, simultaneously-driven blocks and the like, and the change must be considered in counting processing. On the other hand, in FIG. 17B, as the number of simultaneously-driven heat generators in one printing cycle changes in accordance with the construction of the printhead, the process of transfer image data is complicated.

In both cases, the increase in processing load on the printing apparatus main body side cannot be avoided, and in conventional technique nothing could undertake the processing load on the printhead side.

Further, although the printhead and the printing apparatus are separable, and they are separately manufactured, further, the printhead is exchangeable, in the controller of the printing apparatus side, not only data interface with respect to the printhead but also the construction of the printhead must be considered. Thus, development and design of printing apparatus have been very troublesome.

SUMMARY OF THE INVENTION

Accordingly, it is an object of the present invention to provide a printhead with a comparatively simple construction, which reduces the cost of the entire system and development load, effectively utilizes an essential constituent devices of a logic circuit of a printhead such as a shift register, while omits control on a printing apparatus side, and performs stable print operation by itself, while suppresses variation of energy to heat generators due to voltage drop by parasitic resistance, and a printing apparatus using the printhead.

According to one aspect of the present invention, the foregoing object is attained by providing a printhead having plural heat generators, a driver which drives the plural heat generators, and a divider which divides the plural heat generators into plural blocks and time-divisionally drives the plural blocks based on an externally-inputted block selection signal, comprising: a counter which counts the number of simultaneously-driven heat generators based on externally-inputted image data and the block selection signal; and a modulator which modulates a pulse width of a drive signal applied to the simultaneously-driven heat generators based on a value obtained from counting by the counter.

Preferably, the modulator has an input pad in which a signal used for modulating the pulse width of the drive signal is inputted. The modulation circuit has various embodiments in accordance with the type of signal inputted into the input pad.

That is, in a case where the printhead further comprises a plurality of input pads, and drive signals having different pulse widths are respectively inputted into the plurality of input pads, it is preferable that the modulator includes: (1) a memory for storing a plurality of threshold values; (2) a comparator which compares the plurality of threshold values stored in the memory with the value obtained from counting by the counter; and (3) a selector which selects one of the plurality of drive signals having different pulse widths in accordance with the result of comparison by the comparator.

Further, in a case where a clock signal used for inputting the image data is inputted into the input pad, it may be arranged such that the modulator includes: (1) a generator which generates a plurality of drive signals having different pulse widths based on the clock signal; (2) a memory for storing a plurality of threshold values; (3) a comparator which compares the plurality of threshold values stored in the memory with the value obtained from counting by the counter; and (4) a selector which selects one of the plurality of drive signals having different pulse widths generated by the generator, in accordance with the result of comparison by the comparator.

Alternatively, the modulator may include: (1) a memory for storing a plurality of threshold values; (2) a comparator which compares the plurality of threshold values stored in the memory with the value obtained from counting by the counter; and (3) a generator which generates a drive signal having an optimum pulse width, based on the clock signal, in accordance with the result of comparison by the comparator.

Further, in a case where the printhead further comprises: an N-bit shift register which inputs the image data; an N-bit latch circuit which latches N-bit image data stored in the N-bit shift register; and N AND circuits which obtain logical products of the N-bit image data outputted from the N-bit latch circuit and the block selection signal, the counter counts the number of simultaneously-driven heat generators based on outputs from the N AND circuits.

It is preferable that outputs to heat generators which are not simultaneously driven in time-division drive are connected to one of common signal lines, and the common signal lines are connected to the counter.

Note that the circuit related to common signal lines has various embodiments.

That is, it may be arranged such that (1) the common signal lines are pulled up, and inverters are provided between the common signal lines and the N AND circuits, or (2) the common signal lines are pulled down, and open-drain or open-collector outputs from the N AND circuits are connected to the common signal line, or (3) the common signal lines are pulled down, and amplifiers are provided between the common signal lines and the N AND circuits, further, open-drain or open-collector outputs from the amplifiers are connected to the common signal lines, or (4) the common signal lines are pulled down, and diode switches are provided between the common signal lines and the N AND circuits, further outputs from the diode switches are connected to the common signal lines, or (5) in addition to the construction (4), a bus terminator is connected to an end of each of the common signal lines.

Further, the number of common signal lines is equal to or more than a maximum number of heat generators simultaneously-driven in the time-division drive, and less than the number of the heat generators.

Further, the counter is preferably an adder, and the adder adds up outputs from the common signal lines.

It is preferable that the modulator performs modulation such that when the number of simultaneously-driven heat generators obtained from counting by the counter is larger, the pulse width of the drive signal is wider, while when the number of simultaneously-driven heat generators obtained from counting by the counter is smaller, the pulse width of the drive signal is narrower.

Preferably, the printhead is an ink-jet printhead which performs printing by discharging ink. In this case, the printhead has an electrothermal transducer which generates thermal energy to be supplied to the ink, to discharge the ink by utilizing the thermal energy.

According to the present invention, the foregoing object is attained by providing a printing apparatus which performs printing by using the printhead having the above construction.

In accordance with the printhead of the present invention as described above, the pulse width of a drive signal applied to heat generators is automatically modulated in the printhead in accordance with the number of simultaneously-driven heat generators which always changes based on image data.

The invention is particularly advantageous since the variation in energy to the heat generators, due to the number of heat generators driven in the printhead and parasitic resistance of the printhead, can be suppressed, thus stable printing operation can be performed.

In this construction, it is not necessary to control the energy to the heat generators so as to reduce the variation in the energy due to parasitic resistance of the printhead on a printing apparatus side, and it is not necessary to provide special circuits on the printing apparatus side. This results in suppressing increase in production cost. Further, as it is not necessary to consider the characteristic of a printhead in development and design of a printing apparatus, the printing apparatus can be developed independently of the printhead.

Further, according to the Invention, as the signal used for modulating the pulse width of the drive signal in the modulation circuit is one of drive signals having different pulse widths or a clock signal used for image data input, it is not necessary to generate specific data on the printing apparatus side. Also, it is not necessary to process the specific data on the printhead side. Thus, the pulse width of the drive signal can be modulated with a simple construction.

Further, according to the present invention, as signal lines used for counting the number of simultaneously-driven heat generators are commonly used, the area of circuit board can be reduced, thus the printhead can be downsized.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiment of the present invention will now be described in detail in accordance with the accompanying drawings.

First, the concept of the present invention will be described.

<Concept of Invention>

As it is understood from the conventional art, to perform stable printing operation, it is necessary to count the number of simultaneously-driven heat generators based on image data, and feed back the result of counting to drive pulse control, somewhere in a printing apparatus or printhead.

Figure 1A:
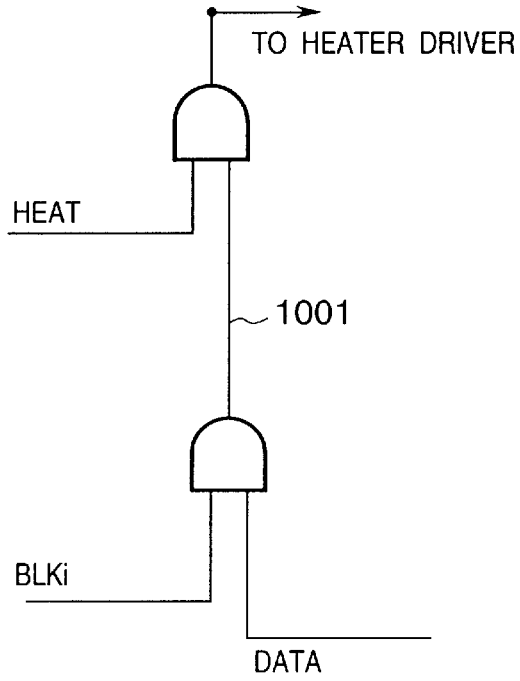
FIGS. 1A and 1B are block diagrams showing a portion to count the number of simultaneously-driven heat generators based on image data, and a problem accompanying counting by the part in FIG. 1A.
Figure 1B:
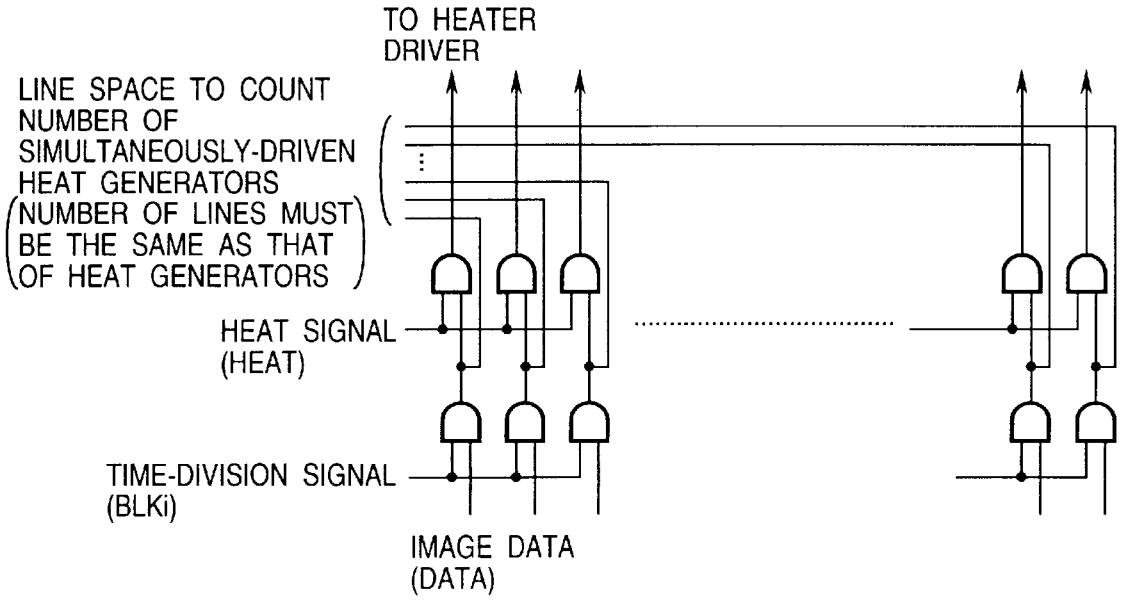

FIGS. 1A and 1B are block diagrams showing the portion to count the number of heat generators simultaneously driven based on image data and the problem accompanying the counting.

FIG. 1A shows the construction of an AND circuit to drive one heater driver (power transistor). FIG. 1B shows the arrangement of the AND circuits in the printhead.

In the present invention, as shown in FIG. 1A, attention is focused on a signal line 1001, which is turned ON when both image data (DATA) and a block selection signal (BLKi) as a time division signal are ON. The number of ON state signal lines 1001 is counted all over the printhead, and the count value is fed back for modulating a pulsewidth of a heat signal (HEAT). Accordingly, it is unnecessary to temporarily store the number of simultaneously-driven heat generators. This arrangement will be described in detail later.

If the above idea is simply applied to manufacturing of circuit board, count lines must be provided corresponding to the number of the heat generators, as shown in FIG. 1B. However, in a current printhead having 128, 256 or more heat generators, to provide a large number of count lines, a considerably large chip size is required. For example, in a printhead having 128 heat generators, if a width of 4 $\mu$m is required for an aluminum (Al) line and insulating space, a chip width of 4×128 $\mu$mm≅0.5 mm is required. Accordingly, the simple application of the above idea to board manufacturing results in deficiency in view of downsizing the apparatus and reducing production cost.

Accordingly, in addition to the above idea, to reduce the area of the circuit board necessary to provide count lines, the present invention focuses attention on the fact that the maximum number of simultaneously-driven heat generators is the maximum number of heat generators which can be simultaneously driven in each time-division drive and the fact that each count line is turned OFF when time-division drive is not performed, and reduces the number of count lines.

Figure 2A:
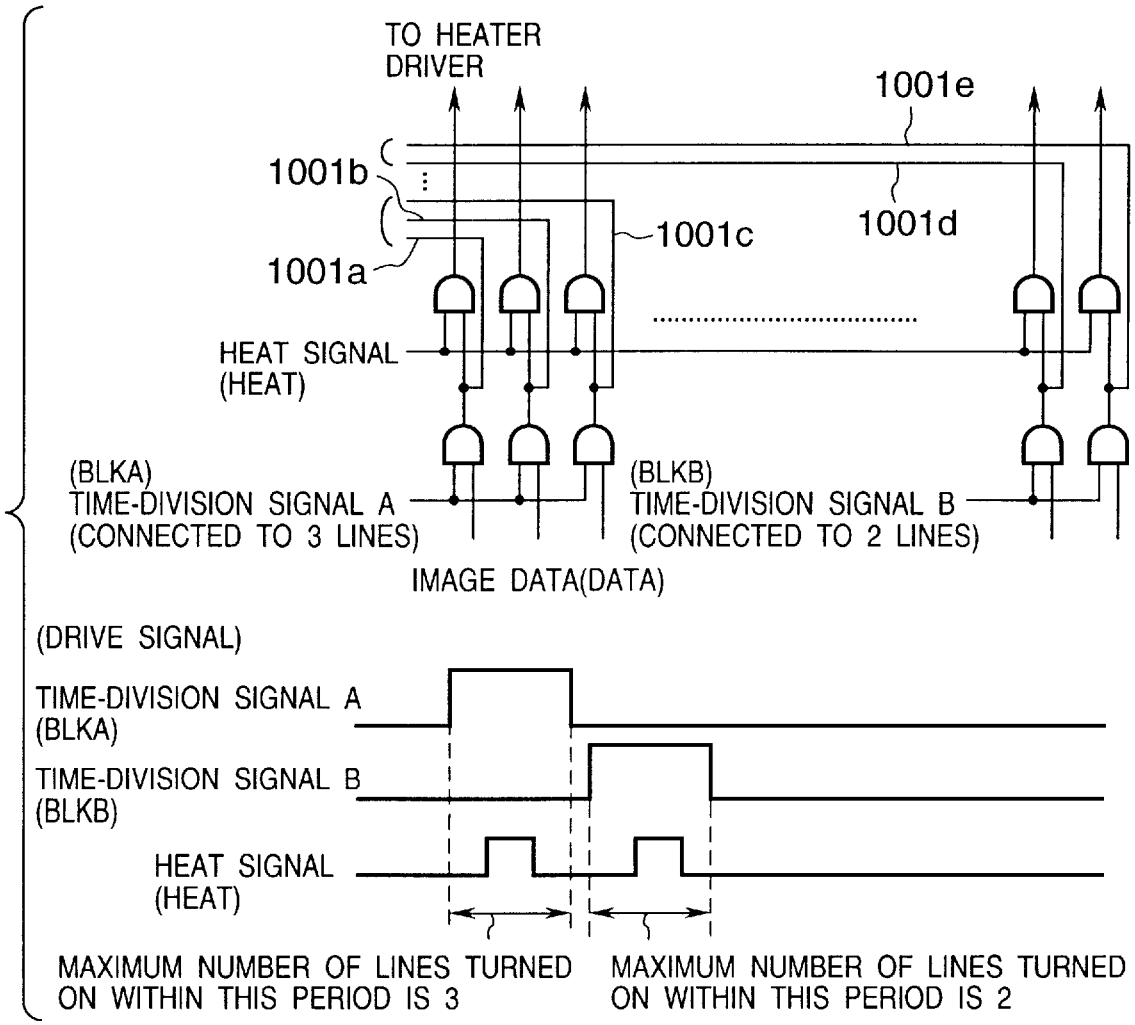
FIGS. 2A and 2B are block diagrams conceptually showing the reduction of the number of count lines.
Figure 2B:
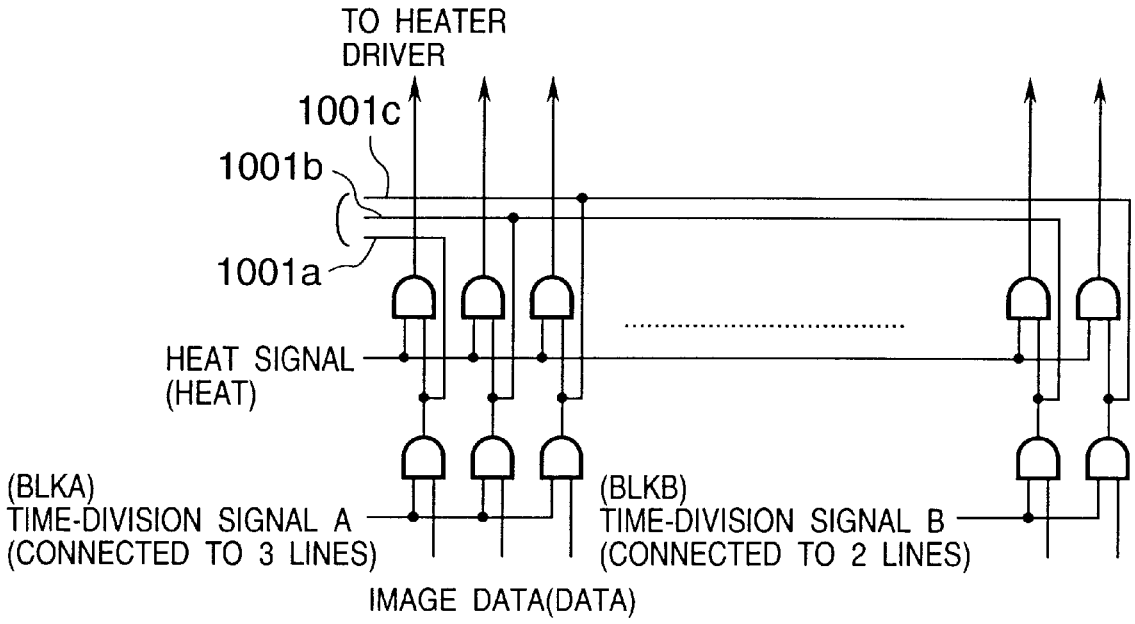

FIGS. 2A and 2B are block diagrams conceptually showing the reduction of the number of count lines.

FIG. 2A shows the number of count lines which are turned ON in each time-division drive. FIG. 2B shows a construction where the count lines are commonly used, in consideration of the above-described maximum number of count lines which are turned ON upon each time-division drive.

As it is understood from FIG. 2A, count lines 1001*a* to 1001*c* are not turned ON when a time division signal A (BLKA) is not ON, and the maximum number of ON lines is "3". At this time, all the other count lines not driven by the time division signal A (BLKA) are turned OFF. Similarly, count lines 1001*d* and 1001*e* can not be turned ON except for a case where a time division signal B (BLKB) is ON, and the maximum number of ON lines is "2". At this time, all the other count lines not driven by the time division signal B (BLKB) are turned OFF.

Accordingly, the number of signal lines necessary to count the number of simultaneously-driven heat generators is the maximum number of heat generators belonging to each time-division section. As shown in FIG. 2B, as a count line belonging to different time-division sections is commonly used for counting in these sections, the number of count lines can be reduced while conflict of ON-state timing can be avoided. As a result, in FIG. 2A, only three count lines 1001*a* to 1001*c* are used.

The commonly-used count lines as above are connected to an adder in the printhead. The adder counts the number of simultaneously-driven heat generators in real time. The result of counting is fed back to heat pulse signal modulation.

Figure 3:
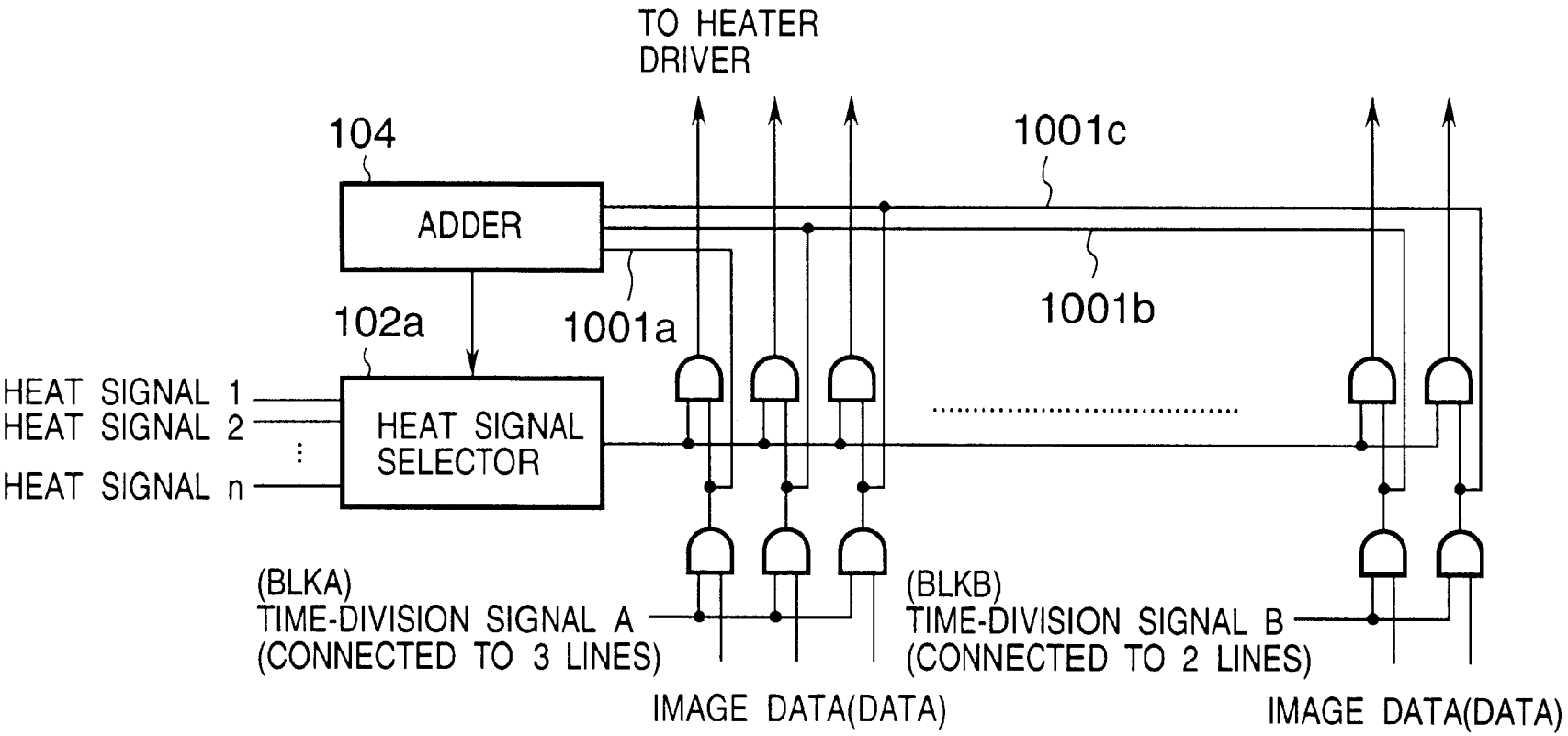
FIG. 3 is a block diagram showing an example of the construction of a circuit which feeds back the number of simultaneously-driven heat generators to heat pulse signal modulation.

FIG. 3 is a block diagram showing an example of the construction of a circuit which feeds back the number of simultaneously-driven heat generators to heat pulse signal modulation.

In FIG. 3, the adder 104, connected to the count lines 1001*a* to 1001*c* commonly used for counting, counts the number of simultaneously-driven heat generators, inputted from these lines, and outputs the result of addition to a heat signal selector 102*a*. On the other hand, the heat signal selector 102*a* inputs a plurality of heat pulse signals having predetermined different pulse widths. The heat signal selector 102*a* selects one of the heat pulse signals in accordance with the result of addition inputted from the adder 104, and uses the selected heat pulse signal as a drive pulse.

Figure 4:
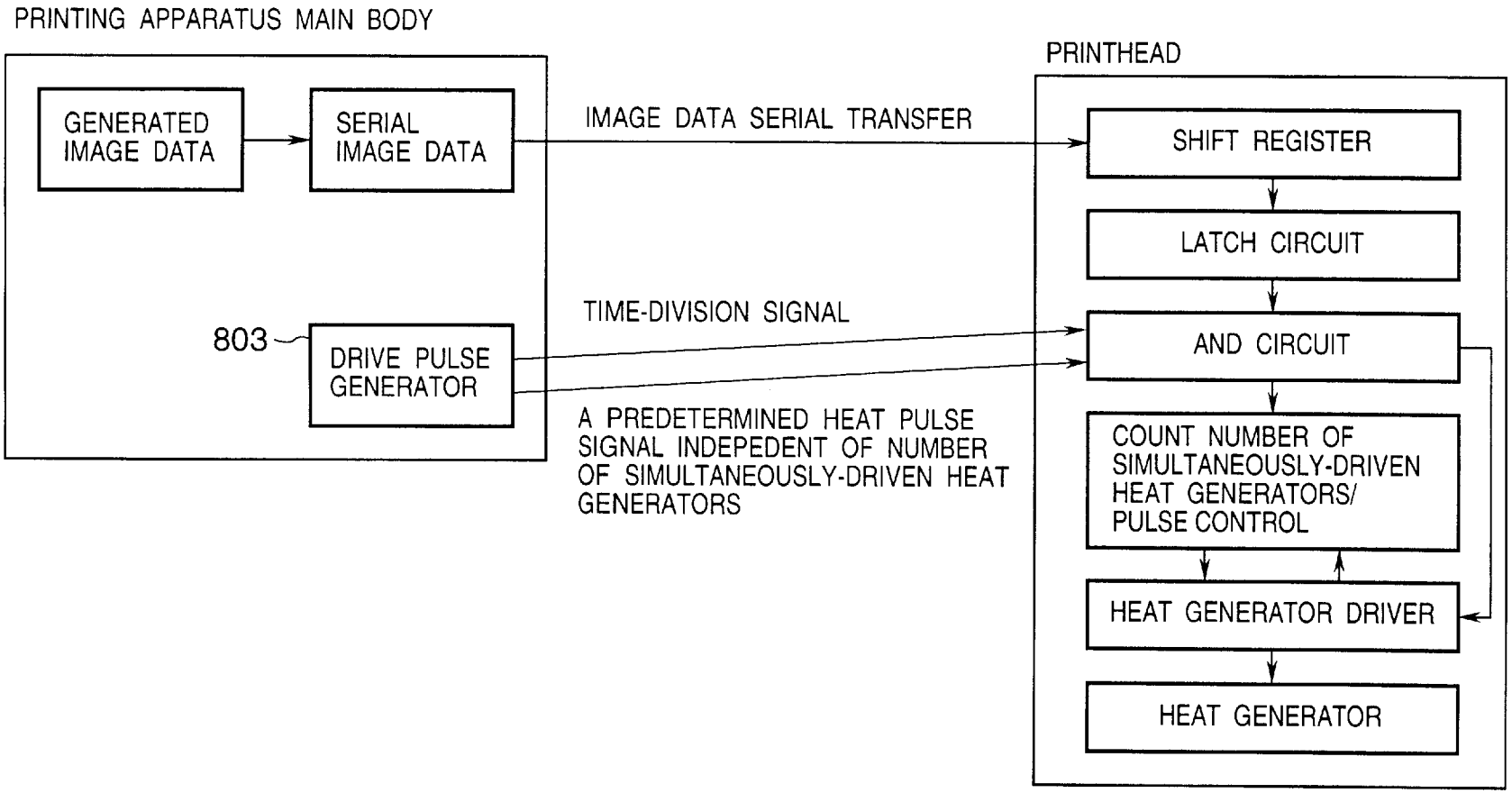
FIG. 4 is a block diagram showing the relation between a printing apparatus and a printhead according to the present invention.

When the printhead having the above construction is mounted on a printing apparatus, the relation between the printing apparatus and the printhead is as shown in FIG. 4. That is, as the printing apparatus simply outputs a plurality of heat pulse signals having predetermined pulse widths generated by the drive pulse generator 803, a circuit in consideration of the construction of the printhead can be omitted on the printing apparatus side. On the other hand, the printhead selects an appropriate heat pulse signal from the input plurality of heat pulse signals, based on the real-timely counted number of simultaneously-driven heat generators, thus enabling heat pulse width to be controlled independently of the printing apparatus.

Hereinbelow, an embodiment to which the above concept of the present invention is applied will be described.

First, the structure of a printer carrying a printhead which performs printing according to the present invention will be described.

<Outline of Apparatus Main Body>

Figure 5:
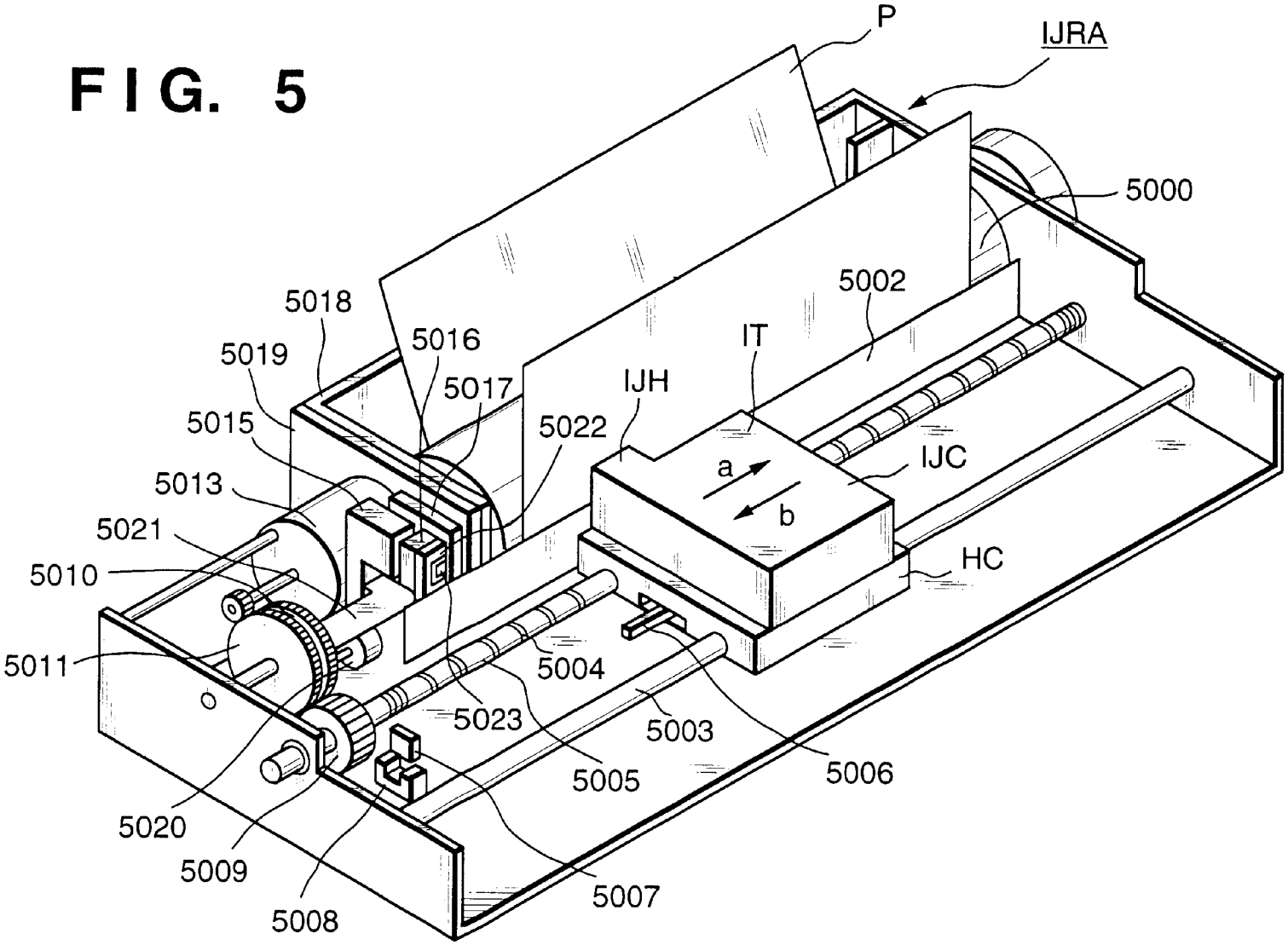
FIG. 5 is a perspective view showing the structure of an ink-jet printer IJRA as a representative embodiment of the present invention.

FIG. 5 is a perspective view showing the structure of an ink-jet printer (hereinafter referred to as "printer") IJRA as a representative embodiment of the present invention. In FIG. 5, a carriage HC is engaged with a spiral groove 5004 of a lead screw 5005 which rotates via drive force transmission gears 5009 to 5011 interlocking with forward/reverse rotation of a drive motor 5013. The carriage HC has a pin (not shown) and is reciprocated in directions represented by arrows a and b held by a guide rail 5003. The carriage HC has an ink-jet cartridge IJC which integrally comprises a printhead IJH and an ink tank IT. A paper holding plate 5002 presses a print sheet P against a platen 5000 along the moving direction of the carriage HC. Photocouplers 5007 and 5008 are home position detecting members for confirming the existence of lever 5006 of the carriage in this area and changing over the rotational direction of motor 5013. A support member 5016 supports a cap member 5022 for capping the front surface of the printhead IJH. A suction member 5015 performs suction-restoration of the printhead through the inside of the cap member 5022 via a cap inner opening 5023. Member 5019 allows a cleaning blade 5017 to move in a back-and-forth direction. A main body support plate 5018 supports the member 5019 and the cleaning blade 5017. It is apparent that any well-known cleaning blade is applicable to the printer of the embodiment. Numeral 5021 denotes a lever for starting the suction operation of the suction-restoration. The lever 5021 moves along the movement of a cam 5020 engaged with the carriage HC. A well-known transmission mechanism such as change-over of a clutch controls a drive force from the drive motor.

When the carriage HC is at the home position area, a desired one of these capping, cleaning and suction-restoration is executed at its corresponding position by the lead screw 5005. The timing of any of these processings is not limited to the printer of the embodiment, if a desired processing is performed at a well-known timing.

Further, in the ink-jet printer IJRA having the above structure, an automatic sheet feeder (not shown) is provided to automatically feed the print sheet P.

<Construction of Controller>

Next, the construction of a controller for executing print-control of the above printing apparatus will be described.

Figure 6:
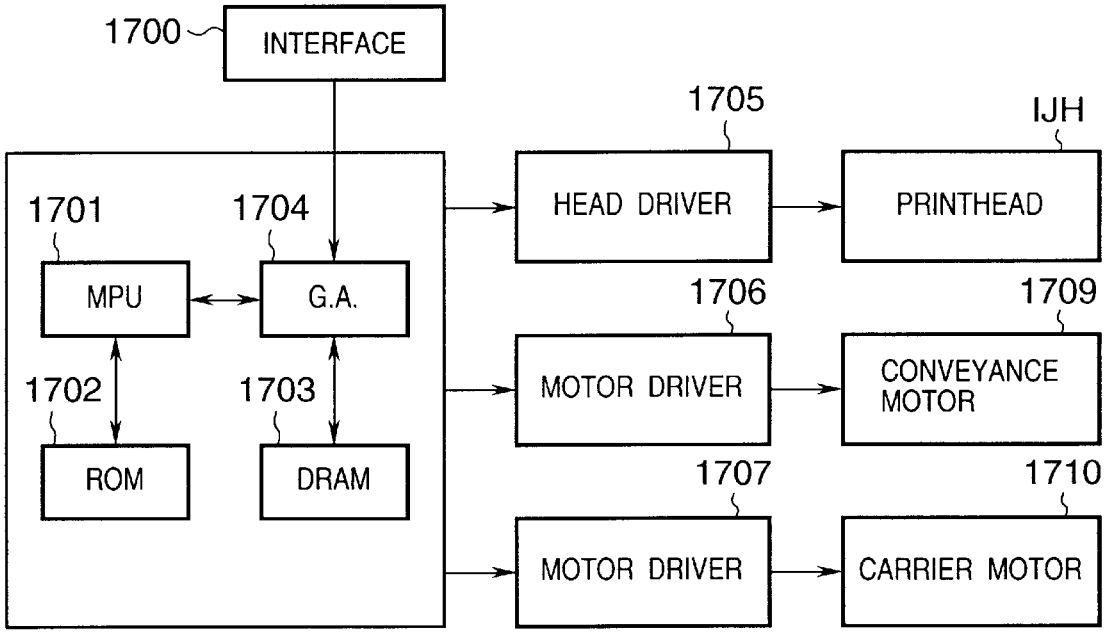
FIG. 6 is a block diagram showing the construction of a controller of the ink-jet printer IJRA.

FIG. 6 is a block diagram showing the construction of a controller of the ink-jet printer IJRA. Referring to FIG. 6 showing the control circuit, reference numeral 1700 denotes an interface for inputting a print signal; 1701, an MPU; 1702, a ROM for storing control programs executed by the CPU 1701; and 1703, a DRAM for storing various data (the print signal, print data and the like supplied to the printhead). Reference numeral 1704 denotes a gate array (G. A.) for performing control on print data supply to the printhead IJH. The gate array 1704 also performs data-transfer control among the interface 1700, the MPU 1701, and the RAM 1703. Reference numeral 1710 denotes a carrier motor for transferring the printhead IJH; 1709, a conveyance motor for conveying the print sheet; 1705, a head driver for driving the printhead IJH; and 1706 and 1707, motor drivers for driving the conveyance motor 1709 and the carrier motor 1710.

The operation of the above control arrangement will be described below. When a print signal is input into the interface 1700, the print signal is converted into print data for a printing operation between the gate array 1704 and the MPU 1701. The motor drivers 1706 and 1707 are driven, and the printhead IJH is driven in accordance with the print data supplied to the head driver 1705, thus performing the printing operation.

<Internal Structure of Printhead IJH>

Figure 7:
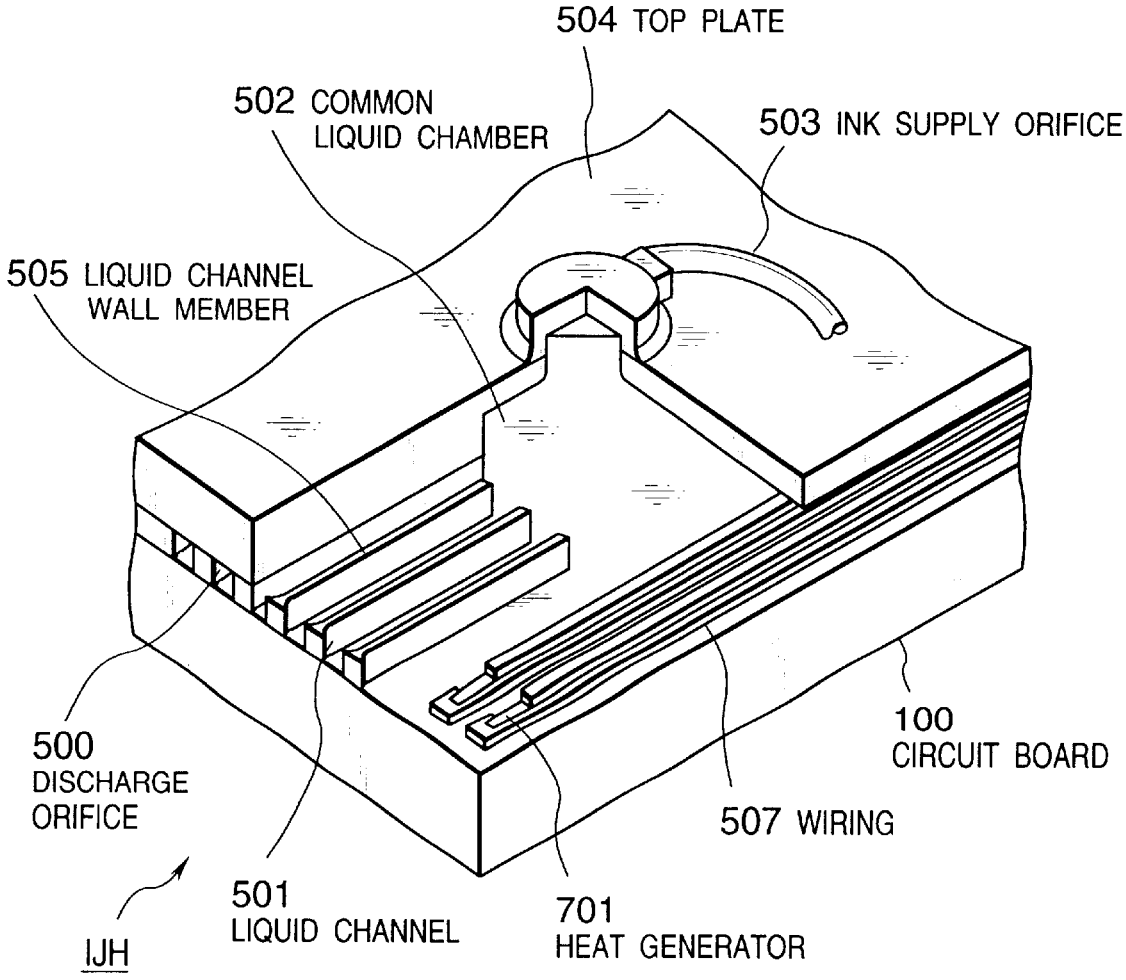
FIG. 7 is a partially-cutaway perspective view showing the internal structure of the printhead mounted on the printer in FIG. 5.

FIG. 7 is a partially-cutaway perspective view showing the internal structure of the printhead IJH.

In FIG. 7, numeral 100 denotes a circuit board holding a logic circuit; 500, orifices for ink discharge; 501, ink channels; 502, a common ink chamber, communicating with the plurality of ink channels, for temporarily storing ink; 503, an ink supply orifice which supplies ink from an ink tank (not shown); 504, a top plate; 505, liquid channel wall members which form the ink channels 501 when assembled with the top plate 504; 701, heat generators; and 507, wirings connecting the logic circuit to the heat generators 701.

The logic circuit, the heat generators 701 and the wirings 507 are formed by semiconductor manufacturing process on the circuit board 100. The top plate holding the ink supply orifice 503 and the liquid channel wall members 505 are attached to the circuit board, thus constructing the printhead IJH. Then, ink supplied from the ink supply orifice 503 is stored in the internal common ink chamber 502 and supplied to the respective ink channels 501. In this state, by driving the heat generators 701, the ink is discharged from the discharge orifices 500.

<Construction of Logic Circuit of Printhead IJH>

Figure 8:
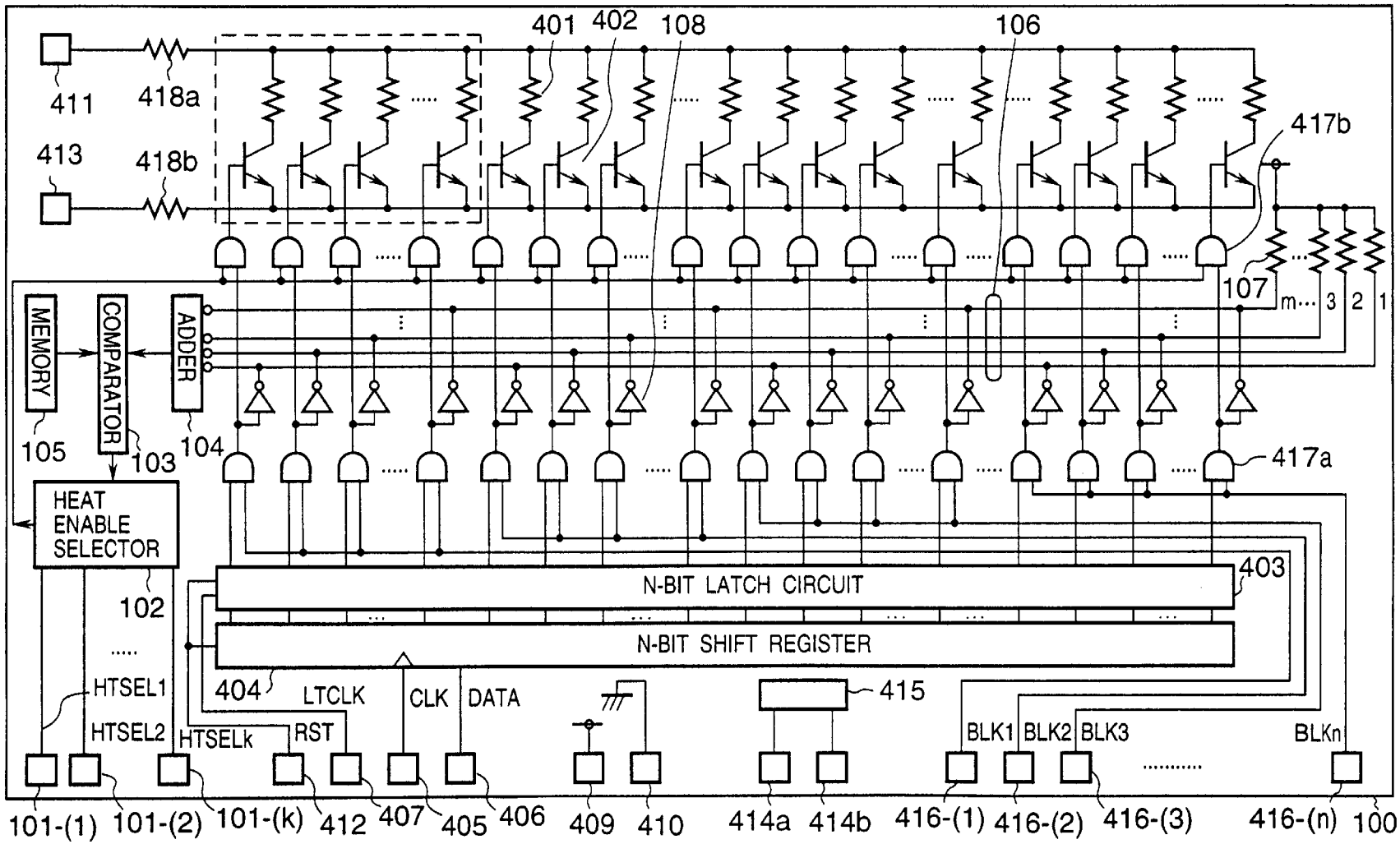
FIG. 8 is a block diagram showing the construction of a logic circuit of a printhead IJH.
Figure 16:
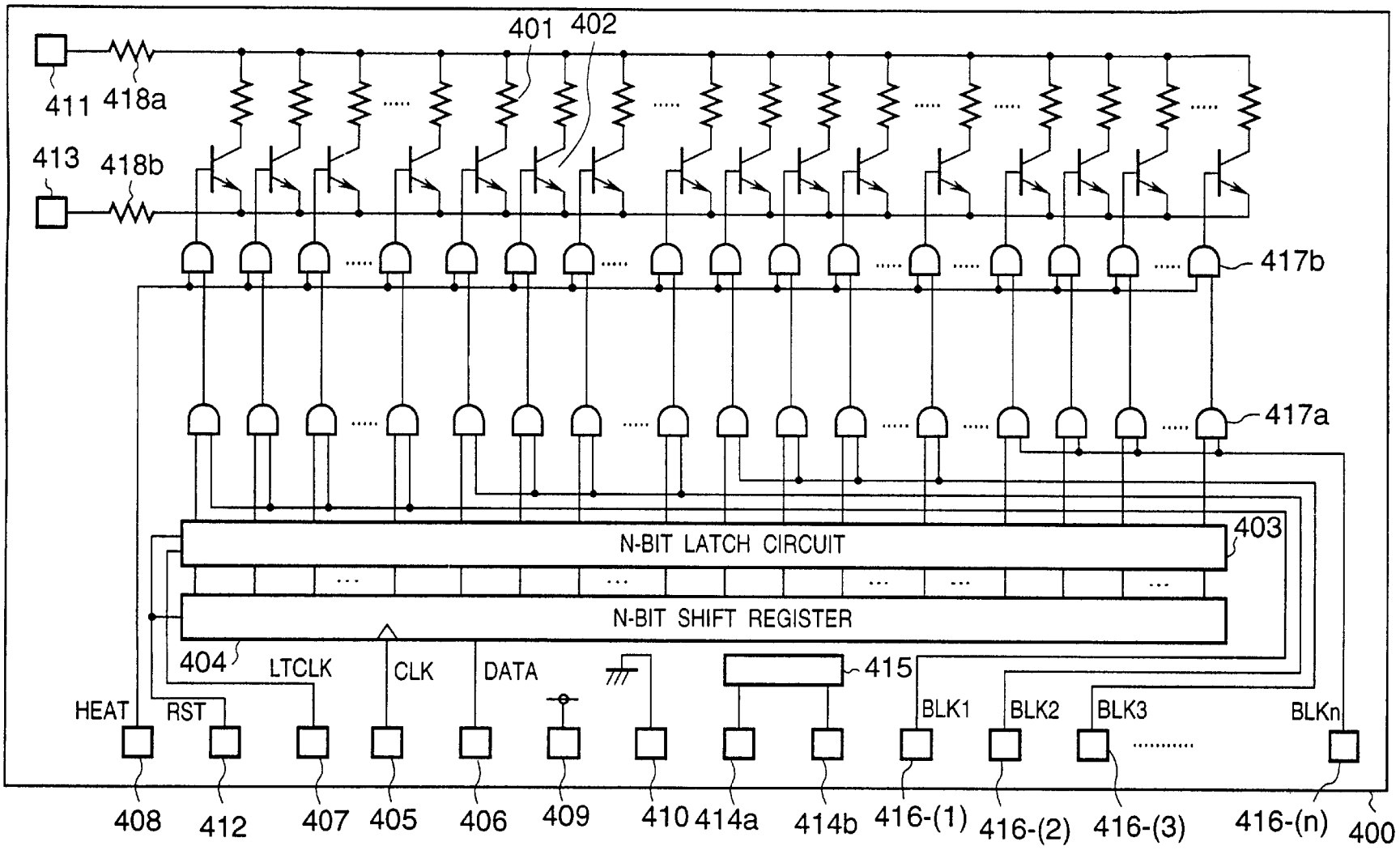
FIG. 16 PRIOR ART
FIG. 16 is a block diagram showing the construction of the logic circuit of the conventional printhead.
Figure 17A:
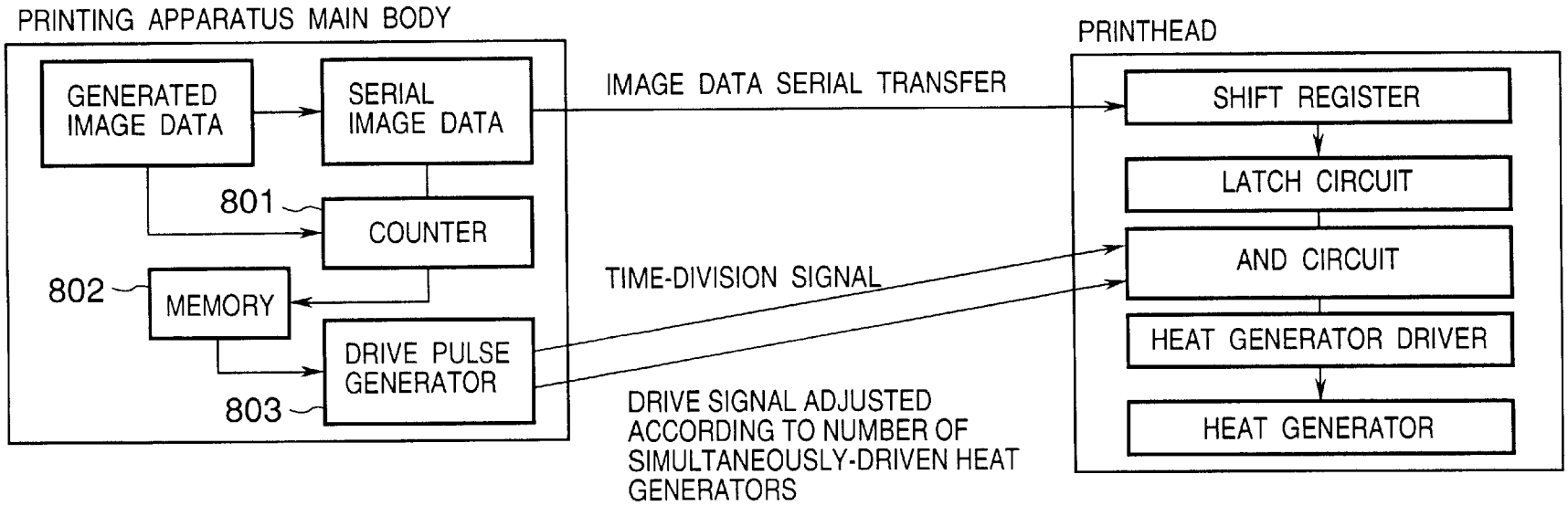
FIGS. 17A and 17B are block diagrams showing the relation between the conventional printhead and printing apparatus.
Figure 17B:
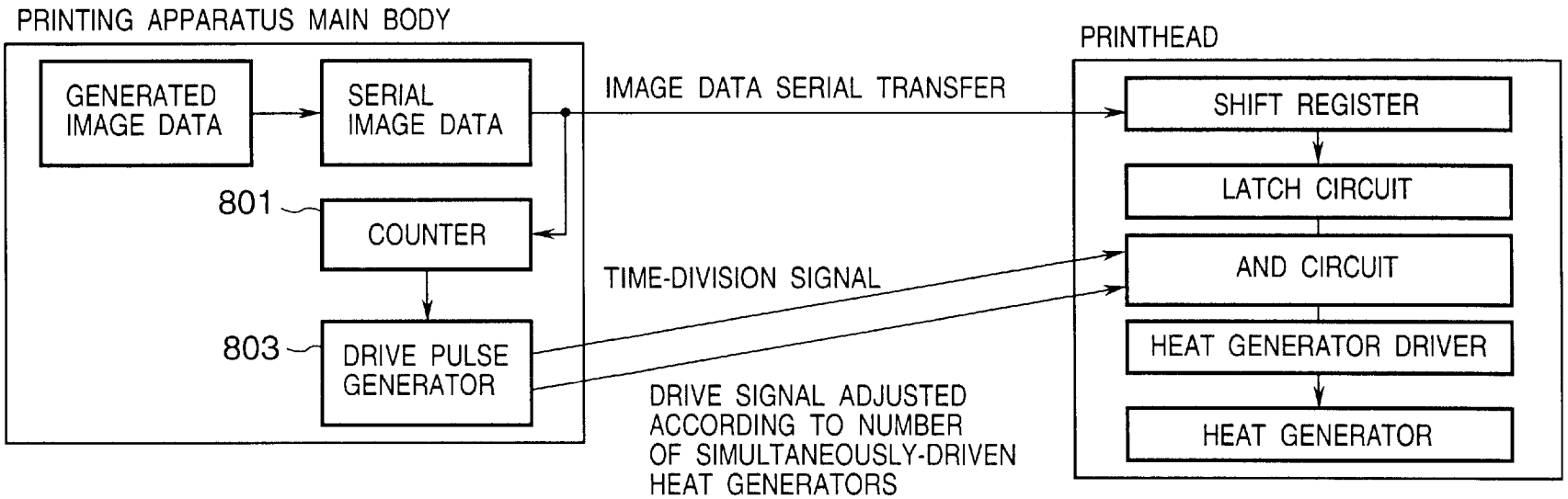
Figure 18:
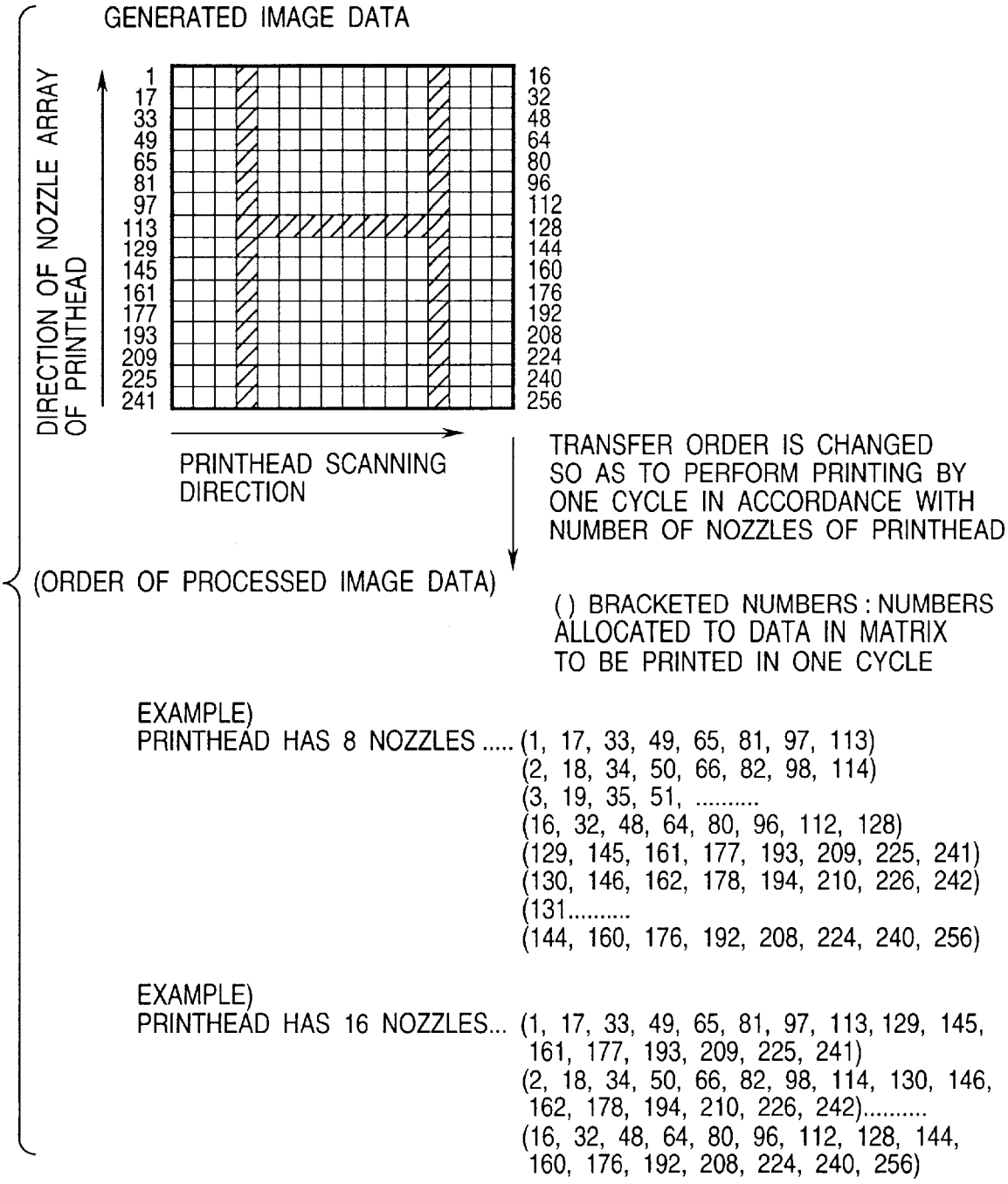
FIG. 18 is an explanatory view showing image data process executed in the conventional printing apparatus.

FIG. 8 is a block diagram showing the construction of the logic circuit of the printhead IJH. In FIG. 8, constituent elements corresponding to those in the conventional logic circuit in FIG. 16 have the same reference numerals, and explanations of the elements will be omitted.

In the above-described concept of the present invention, in time-division drive of the printhead, regarding heat generators driven at different timings, the count line is commonly used. In an actual logic circuit, various circuits are used to input outputs from the count lines into the adder. In the example of FIG. 8, the output from an AND circuit 417*a* is inverted by an inverter and pulled up.

In FIG. 8, numerals 101-(1) to 101-(k) denote input pads for inputting heat enable signals (HTSEL1 to HTSELk) having different pulse widths supplied from the printer IJRA; 102, a heat enable selector which selects one of the plurality of heat enable signals (HTSEL1 to HTSELk); 103, a comparator which outputs a signal to control the selected heat enable signal from the heat enable selector 102; 104, the adder which adds the number of heat generators simultaneously-driven in time-division drive of the printhead, and outputs the result of addition to the comparator 103; and 105, a memory for storing threshold data for comparison with the output from the adder 104 by the comparator 103.

Numeral 106 denotes m (=N/n) signal lines (count lines) used for determination of the number of simultaneously-driven heat generators; 107, m pull-up resistors; and 108, inverters of open-drain (or open-collector) output. The count lines 106 are connected to the adder 104.

As the inverters 108 are provided in correspondence with the respective AND circuits 417*a*, N inverters 108 are provided in the logic circuit. The outputs from the inverters 108 are connected to the count lines 106. As described above, in connection between the inverters 108 and the count lines 106, the outputs from the AND circuits 417*a* selected in the same block by the block selection signal (BLK2 to BLKn) are not connected to the same count line 106. By this connection, the maximum count value at the adder 104 is m (=N/n). Further, the respective count lines in the adder 104 are pulled up by the resistors 107.

According to the above construction, as the number of signal lines necessary to count the number of heat generators simultaneously driven by time-division drive and the possible count value can be N/n, the increase in the construction of the logic circuit can be suppressed.

Next, drive control of the printhead having the above construction will be described in a case where the number of heat generators is 128 (N=128), the number of time division drive is 8 (n=8), the maximum number of simultaneously-driven heat generators is 16 (m=N/n=128/8), the number of heat enable signals is 4 (k=4), the number of count lines 106 is 16, and the heat enable signals (HTSEL1 to HTSEL4) are inputted into the input pads 101-(1) to 101(4).

Accordingly, in this example, the maximum count value of the adder 104 is "16".

On the other hand, three threshold values are stored in the memory 105. The comparator 103 compares these threshold values with the count value (CNT) of the adder 104. If $1 \leqq CNT \leqq 4$ holds, the heat enable selector 102 selects the heat enable signal HTSEL1; if $5 \leqq CNT \leqq 8$ holds, the heat enable selector 102 selects the heat enable signal HTSEL2; if $9 \leqq CNT \leqq 12$ holds, the heat enable selector 102 selects the heat enable signal HTSEL3; and if $13 \leqq CNT \leqq 16$ holds, the heat enable selector 102 selects the heat enable signal HTSEL4.

Figure 9:
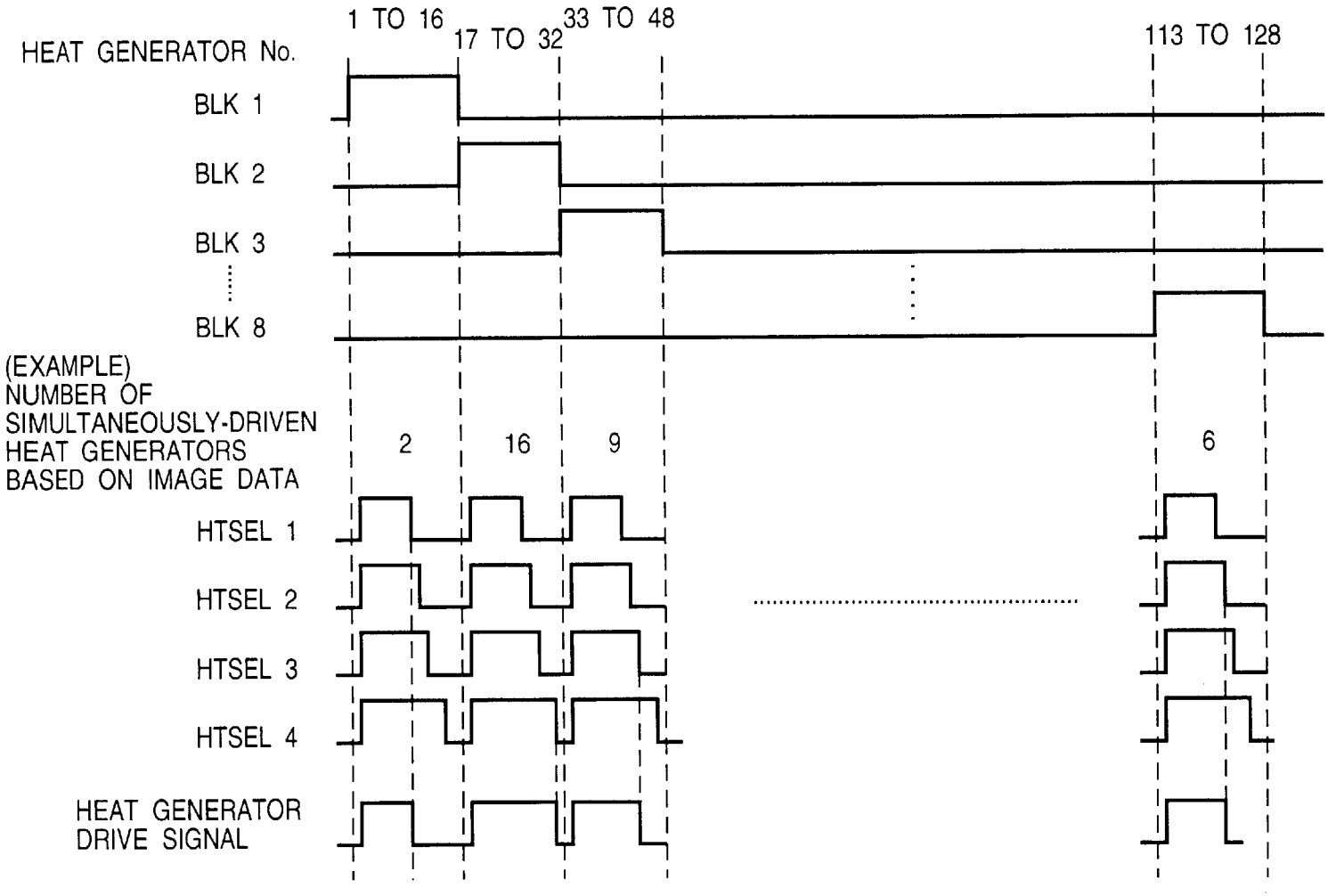
FIG. 9 is a timing chart showing various signals used for printing operation.

FIG. 9 is a timing chart showing various control signals used for drive control on the printhead.

As is in the case of the conventional art, 128-bit image data (DATA) is inputted into the 128-bit shift register 404 in accordance with the clock (CLK). Further, the image data is stored into the 128-bit latch circuit 403 in accordance with the latch clock (LTCLK).

Thereafter, the heat generators are driven based on the latched image data. As shown in FIG. 9, the 128 heat generators are divided into eight blocks each including 16 heat generators, and driven by the block selection signals (BLK1 to BLK8). In FIG. 9, numerals 1 to 128 are allotted to the 128 heat generators. The heat generators 1 to 16 are selected by the block selection signal BLK1; the heat generators 17 to 32 are selected by the block selection signal BLK2; and the heat generators 113 to 128 are selected by the block selection signal BLK8.

As an example, FIG. 8 shows the heat generators surrounded by a broken-line, selected by the block selection signal BLK1 as objects of time-division drive.

Next, the four heat enable signals (HTSEL1 to HTSEL4) having different pulse widths are inputted from the printer IJRA via the input pads 101-(1) to 101(4). As shown in FIG. 9, as the relation among the pulse widths of the heat enable signals, HTSEL1<HTSEL2<HTSEL3<HTSEL4 holds.

The number of heat generators simultaneously driven in each time-divisionally driven block (the number of simultaneously-driven heat generators) is determined based on the image data (DATA) latched by the 128-bit latch circuit 403. In an example shown in FIG. 9, the numbers in the respective blocks are 2, 16, 9, . . . , 6.

Under these conditions, the adder 104 adds the number of simultaneously-driven heat generators and outputs the result of addition into the comparator 103. Then, the heat generators selected by the block selection signal BLK1 are driven with the heat enable signal HTSEL1 as a heat generator drive signal. The heat generators selected by the block selection signal BLK2 are driven with the heat enable signal HTSEL4 as a heat generator drive signal. The heat generators selected by the block selection signal BLK3 are driven with the heat enable signal HTSEL3 as a heat generator drive signal. Then, the heat generators selected by the block selection signal BLK8 are driven with the heat enable signal HTSEL2 as a heat generator drive signal.

In this manner, the greater the number of simultaneously-driven heat generator becomes, the wider the pulse width supplied to the heat generators becomes. If the number of simultaneously-driven heat generators is large, the voltage drop due to the parasitic resistance is large, which reduces the voltage at both ends of the heat generator. To compensate the reduction of actual power supplied to the heat generators due to the voltage drop, the pulse width is increased so as to obtain uniform power.

In the above description, specific numbers are employed as the number of heat generators, the number of heat enable signals (referred to as "level number"). Assuming that the pulsewidth of the heat enable signal is wider as the level number is greater, the relation between the simultaneously-driven heat generators and each level is in a general form as shown in Table 1.

[TABLE 1]

| LEVEL | SIMULTANEOUSLY-DRIVEN HEAT GENERATORS |
|---|---|
| 1 | 1 to N/n |
| 2 | N/n + 1 to 2N/n |
| . . . | . . . |
| i | (i − 1) × N/n + 1 to i × N/n |
| . . . | . . . |
| k | (n − 1)N/n to N |

Figure 10:
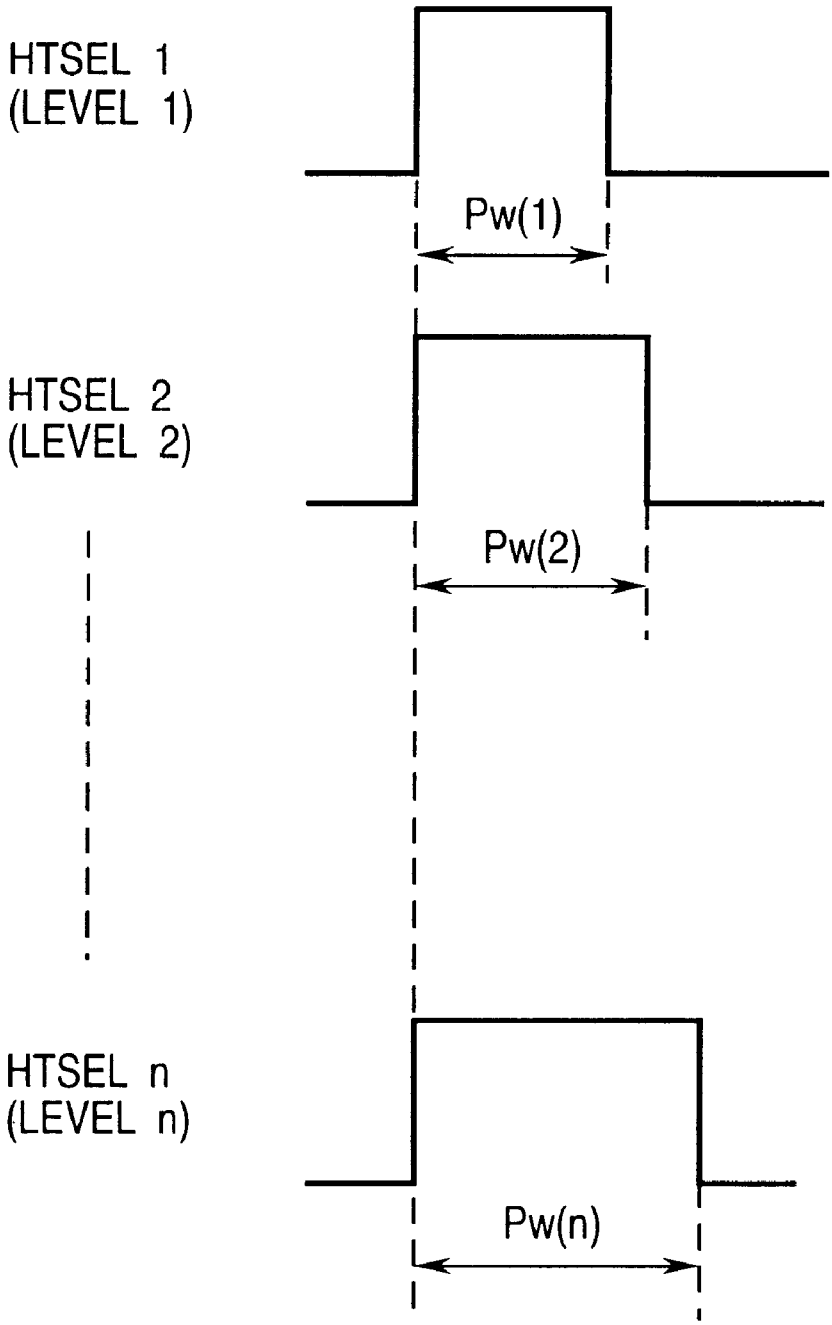
FIG. 10 is a timing chart showing pulse waveforms of heat enable signals.

Further, as the count lines 106 connected to the adder 104 are pulled up, in data transferred on the count lines 106, a period required for changing from an active state ("L") to an inactive state ("H") is longer than that required for changing from an inactive state ("H") to an active state ("L"). Accordingly, it is desirable that the pulse waveforms of the heat enable signals have rising edges at the same timing, and have different falling edges, thus having different pulse widths, as shown in FIG. 10.

Assuming that an appropriate pulse width at level 1 is Pw(1), the resistance value of one heat generator is R, and the parasitic resistance value that occurs on wiring related to the heat generator or power transistor is r, the pulse width at an arbitrary level (i) is expressed as follows:

$$Pw(i)=(2Xr+R)\cdot Pw(1)/(2r+R)$$

$$X=(i-1)\cdot N/k \quad (i<k).$$

In accordance with the above-described embodiment, a circuit which selects one of a plurality of heat enable signals based on the number of simultaneously-driven heat generators is provided on a logic circuit board of a printhead. In this arrangement, if a printer carrying the printhead simply supplies a plurality of heat enable signals having different pulse widths to the printhead, in the printhead, a heat enable signal having an optimum pulse width is automatically selected in accordance with image data in real time, and printing operation is performed.

According to this arrangement, if the number of simultaneously-driven heat generators is small, since the voltage drop due to parasitic resistance is small, a heat enable signal having a relatively narrow pulse width is applied. On the other hand, if the number of simultaneously-driven heat generators is large, since the voltage drop due to parasitic resistance is large, a heat enable signal having a relatively wide pulse width is applied so as to compensate for power loss due to the parasitic resistance. Accordingly, even though the number of simultaneously-driven heat generators changes based on image data, approximately constant energy is supplied to the heat generators. Thus, a stable printing operation can always be performed.

Further, this energy uniformization contributes to realization of a long life for the printhead.

Further, as the printhead having the above-described construction does not use a clock synchronization circuit for a heat enable signal selection, printing operation is highly tolerant to noise. Furthermore, the circuit for heat enable signal selection can be formed in a layer under the wiring of the heat generators and power transistors and the like, of the logic circuit board, which conventionally has not been fully utilized for prevention of erroneous operation, together with these devices, by a semiconductor manufacturing process. In this case, the chip size is not substantially different from the conventional chip size.

Further, the selection of heat enable signal having an optimum pulse width can be automatically performed within the printhead. In other words, the printing apparatus side does not have to be involved in the selection. The printing apparatus side simply transmits a plurality of heat enable signals having different widths to the printhead. Thus, it is not necessary for the printing apparatus to perform various control in accordance with the construction of the printhead as pointed out in the conventional techniques. Accordingly, the printing apparatus and the printhead can be designed and manufactured independently of each other except for matching between respective signal interfaces, and factors considered in design can be reduced.

Note that in the above description, the number of heat generators is 128; however, the present invention is not limited to this number. The number of heat generators may be 256 or 512, for example.

<Various Modifications in Connection with a Common Use of Count Lines>

In the construction as shown in FIG. 8, the inverters 108 are provided between the AND circuits 417*a* and the count lines 106, and the count lines are pulled up, however, the present invention is not limited to this arrangement, but various modifications can be made. Hereinbelow, some of these modifications will be described.

(1) First Modification

Figure 11:
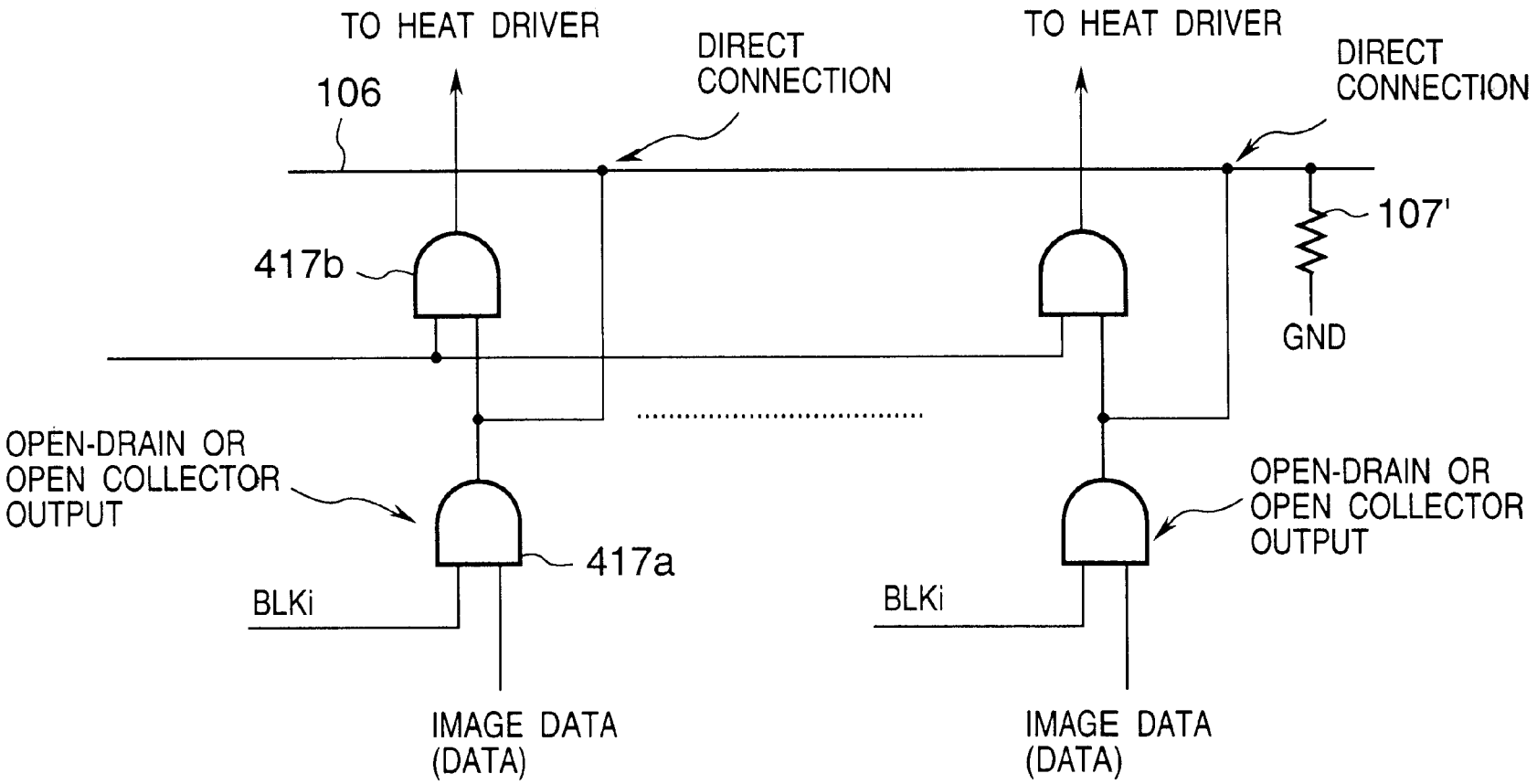
FIG. 11 is a block diagram showing a first modification in connection with a common use of the count lines.

FIG. 11 is a block diagram showing a first modification.

In FIG. 11, the open-drain or open-collector output from the AND circuit 417*a* is directly connected to the count line 106, and the count line 106 is connected the ground by using a pull-down resistor 107', thus pulled down.

(2) Second Modification

Figure 12:
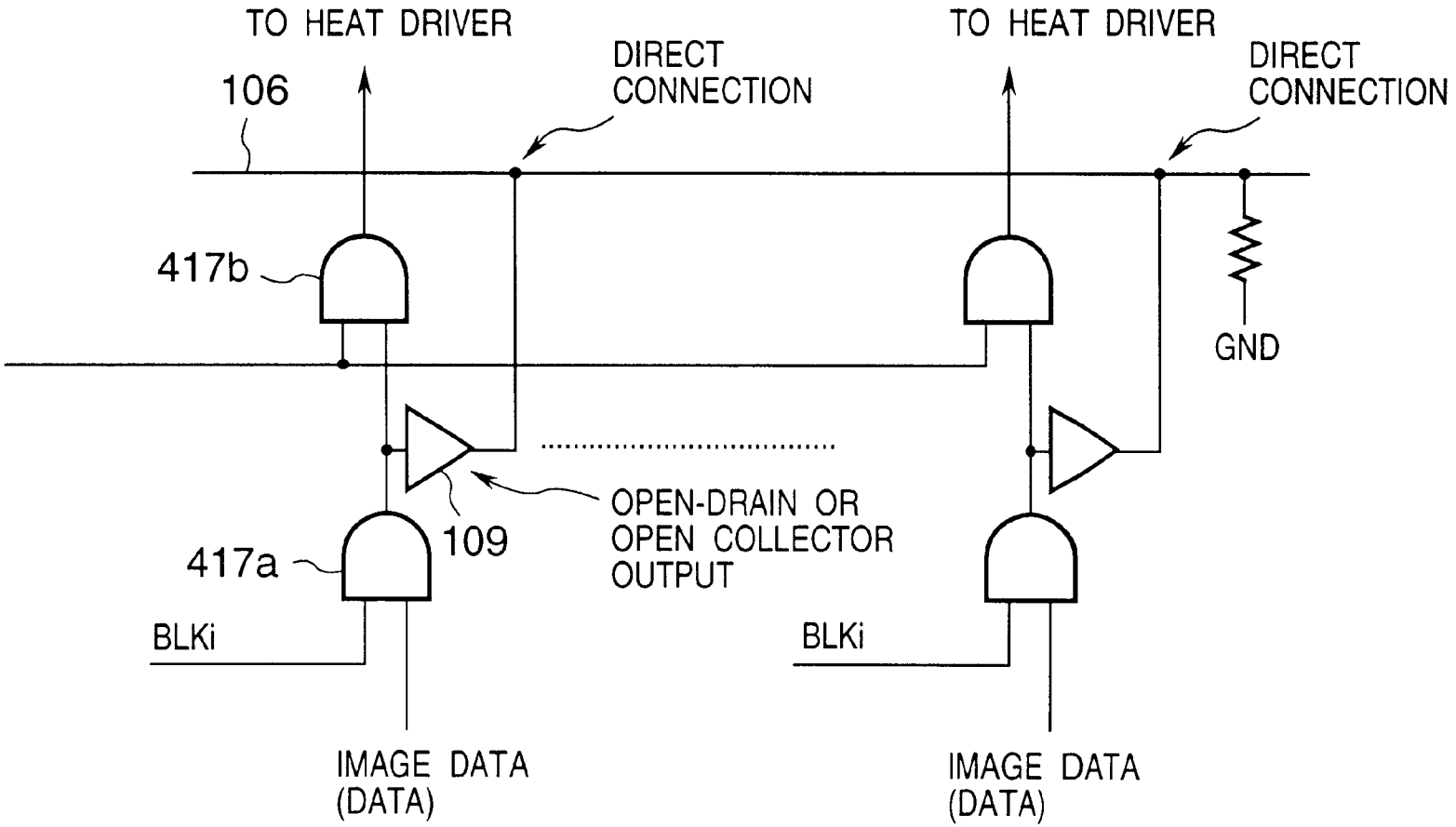
FIG. 12 is a block diagram showing a second modification in connection with a common use of the count lines.

FIG. 12 is a block diagram showing a second modification.

In FIG. 12, the output from the AND circuit 417*a* is amplified via an OP amplifier 109, and open-drain or open-collector output from the OP amplifier 109 is directly connected to the count line 106. The count line 106 is connected to the ground, by using the pull-down resistor 107', thus pulled down.

In this arrangement, as an amplified signal is outputted onto the count line 106, the voltage drop can be suppressed in a case where the distance from the contact of the count line 106 to the adder is long.

(3) Third Modification

Figure 13:
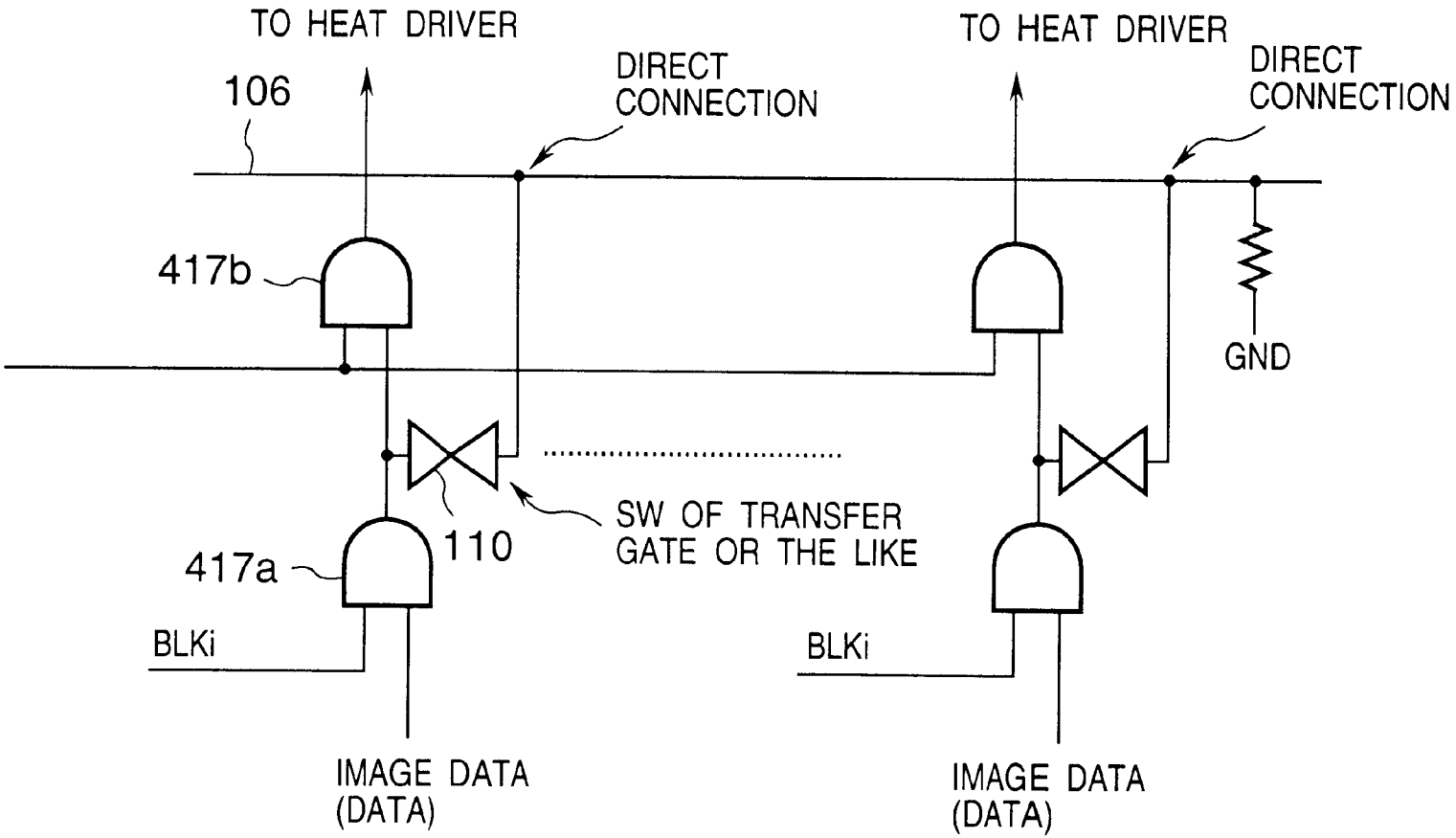
FIG. 13 is a block diagram showing a third modification in connection with a common use of the count lines.

FIG. 13 is a block diagram showing a third modification.

In FIG. 13, the output from the AND circuit 417*a* is directly connected to the count line 106 via a switch 110 comprising a diode or the like, and the count line 106 is connected to the ground by using the pull-down resistor 107', thus pulled down.

This arrangement prevents entrance of signal outputted onto the count line 106 from another AND circuit 417*a* in an opposite direction by setting a threshold value of the switch 110 to a predetermined voltage value.

(4) Fourth Modification

Figure 14:
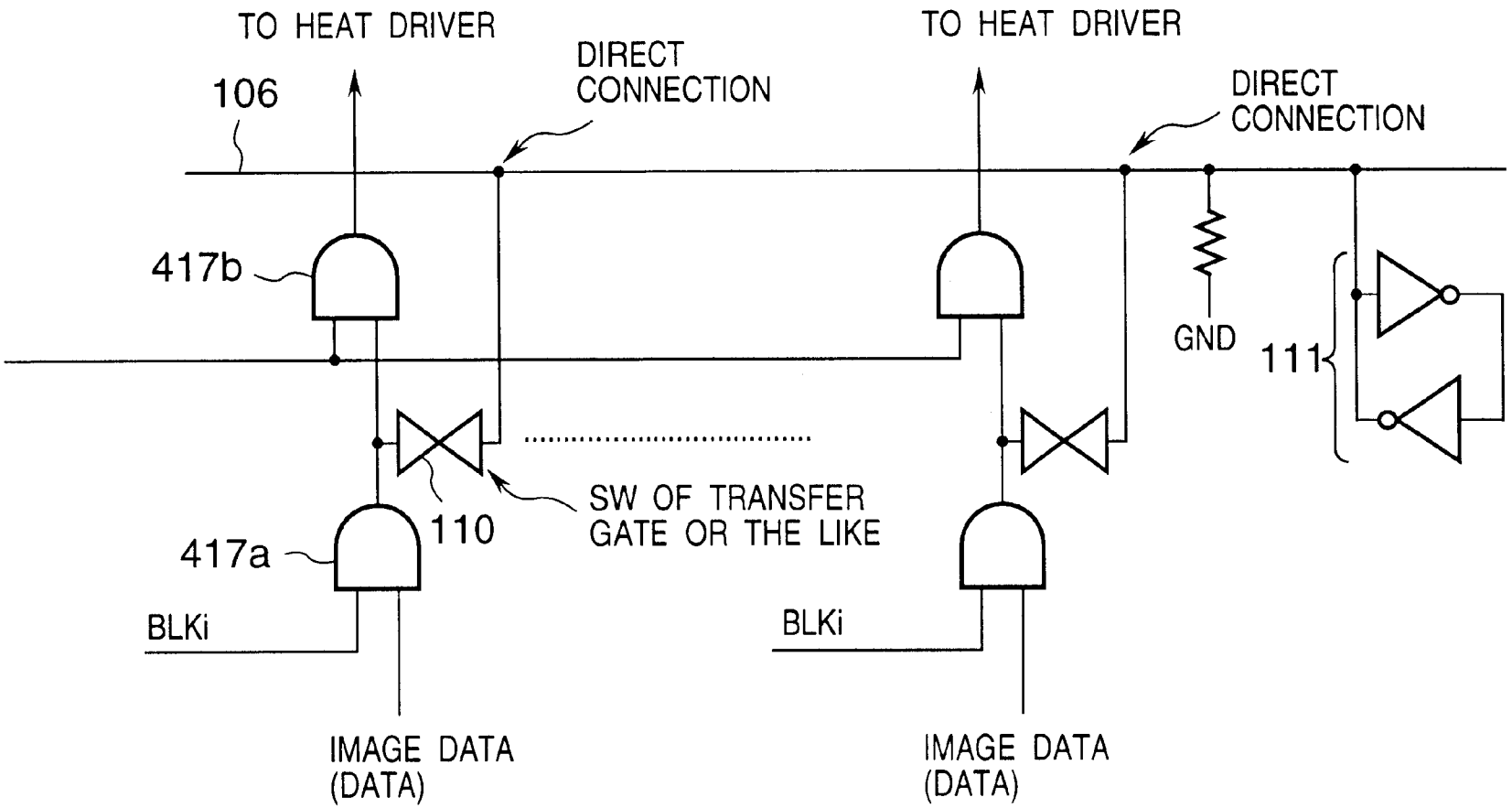
FIG. 14 is a block diagram showing a fourth modification in connection with a common use of the count lines.

FIG. 14 is a block diagram showing a fourth modification.

In FIG. 14 having the same construction as that of FIG. 13, a bus terminator 111 is added to the end of the count line 106 so as to improve the drive performance with respect to the count line 106.

<Modification of Optimum Heat Enable Signal Generator>

In the above-described embodiment, a plurality of heat enable signals having different pulse widths are inputted, and a heat enable signal having an optimum pulse width is selected, however, the present invention is not limited to this arrangement, but various modifications can be provided.

That is, in place of the construction to input a plurality of heat enable signals and select one of these signals, a circuit which inputs a clock (CLK) used for image data (DATA) transfer and generates a plurality of heat pulse signals having different pulse widths based on the clock (CLK) may be provided in the printhead. Then, as described above, the comparator 103 compares the result of addition by the adder 104 with the threshold data stored in the memory 105, and a heat enable signal having an optimum pulse width can be selected from the generated signals, based on the result of comparison.

In this arrangement, as the pads for inputting the plurality of heat enable signals are omitted, the area of the circuit board can be reduced, thus the printhead circuit board can be downsized.

Figure 15:
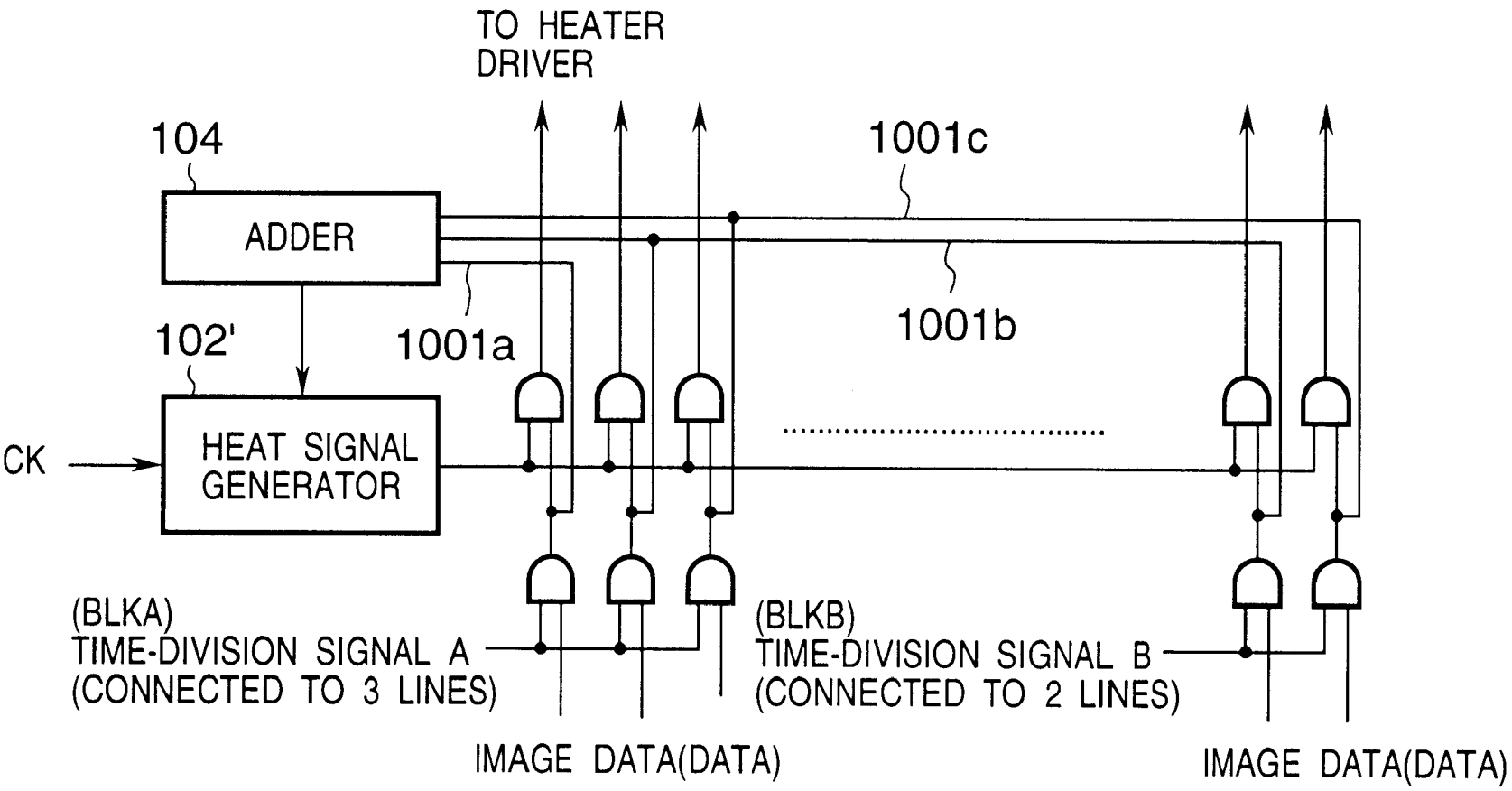
FIG. 15 is a block diagram showing a modification of an optimum heat enable signal generator.

Alternatively, as shown in FIG. 15, the printhead may have a heat signal generator 102' which inputs the clock (CLK) used for image data (DATA) transfer and directly generates a heat enable signal having an optimum pulse width based on the clock (CLK) and the result of comparison by the comparator 103 between the result of addition by the adder 104 and the threshold data stored in the memory 105.

In the above-described embodiment, the printhead performs printing in accordance with an ink-jet method, however, the present invention is not limited to this printhead. The present invention is applicable to a printhead which performs printing in accordance with e.g. a thermal-transfer method or thermal printing method.

However, the present invention can attain a high-density, high-precision printing operation by employing an ink-jet printer, which comprises means (e.g., an electrothermal transducer, laser beam generator, and the like) for generating heat energy as energy utilized upon execution of ink discharge, and causes a change in state of an ink by the heat energy, among the ink-jet printers.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one drive signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the drive signal. By discharging the liquid (ink) through a discharge opening by growth and shrinkage of the bubble, at least one droplet is formed. If the drive signal is applied as a pulse signal, the growth and shrinkage of the bubble can be attained instantly and adequately to achieve discharge of the liquid (ink) with the particularly high response characteristics.

As the pulse drive signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Publication Laid-Open No. 59-123670 which discloses the arrangement using a slot common to a plurality of electrothermal transducers as a discharge portion of the electrothermal transducers, or Japanese Patent Publication Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive an ink from the apparatus main unit upon being mounted on the apparatus main unit can be applicable to the present invention as well as a cartridge type printhead in which an ink tank is integrally arranged on the printhead itself, as described in the above embodiment.

It is preferable to add recovery means for the rinthead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is general practice to perform temperature control of the ink itself within a range from 30° C. to 70° in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through-holes, as described in Japanese Patent Publication Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader and the like, or a facsimile apparatus having a transmission/reception function in addition to an image output terminal of an information processing apparatus such as a computer.

The present invention can be applied to a system constituted by a plurality of devices (e.g., a host computer, an interface, a reader and a printer) or to an apparatus comprising a single device (e.g., a copying machine or a facsimile apparatus).

As many apparently widely different embodiments of the present invention can be made without departing from the spirit and scope thereof, it is to be understood that the invention is not limited to the specific embodiments thereof except as defined in the appended claims.

What is claimed is:

1. A printhead having plural heat generators, a driver which drives said plural heat generators, and a divider which divides said plural heat generators into plural blocks and time-divisionally drives said plural blocks based on an externally-inputted block selection signal, comprising:

a counter which counts the number of simultaneously-driven heat generators based on externally-inputted image data and the block selection signal; and a modulator which modulates a pulse width of a drive signal applied to said simultaneously-driven heat generators based on a value obtained from counting by said counter.

2. The printhead according to claim 1, wherein said modulator has an input pad in which a signal used for modulating the pulse width of the drive signal is inputted.

3. The printhead according to claim 2, wherein a clock signal used for inputting the image data is inputted into said input pad.

4. The printhead according to claim 3, wherein said modulator includes:

a generator which generates a plurality of drive signals having different pulse widths based on the clock signal;

a memory for storing a plurality of threshold values;

a comparator which compares the plurality of threshold values stored in said memory with the value obtained from counting by said counter; and a selector which selects one of the plurality of drive signals having different pulse widths generated by said generator, in accordance with the result of comparison by said comparator.

5. The printhead according to claim 3, wherein said modulator includes:

a memory for storing a plurality of threshold values;

a comparator which compares the plurality of threshold values stored in said memory with the value obtained from counting by said counter; and a generator which generates a drive signal having an optimum pulse width, based on the clock signal, in accordance with the result of comparison by said comparator.

6. The printhead according to claim 2, wherein a plurality of the input pads are provided, and drive signals having different pulse widths are respectively inputted into said plurality of the input pads.

7. The printhead according to claim 3, wherein said modulator includes:

a memory for storing a plurality of threshold values;

a comparator which compares the plurality of threshold values stored in said memory with the value obtained from counting by said counter; and a selector which selects one of the drive signals having different pulse widths in accordance with the result of comparison by said comparator.

8. The printhead according to claim 1, further comprising:

a shift register which inputs the image data;

a latch circuit which latches the image data stored in said shift register; and

AND circuits which obtain logical products of the image data outputted from said latch circuit and the block selection signal, wherein said counter counts the number of simultaneously-driven heat generators based on outputs from said AND circuits.

9. The printhead according to claim 8, wherein outputs to heat generators which are not simultaneously driven in time-division drive are connected to one of common signal lines, and wherein said common signal lines are connected to said counter.

10. The printhead according to claim 9, wherein said common signal lines are pulled up, and further comprising inverters provided between said common signal lines and said AND circuits.

11. The printhead according to claim 9, wherein said common signal lines are pulled down, and wherein open-drain or open-collector outputs from said AND circuits are connected to said common signal lines.

12. The printhead according to claim 9, wherein said common signal lines are pulled down, and further comprising amplifiers provided between said common signal lines and said AND circuits, and wherein open-drain or open-collector outputs from said amplifiers are connected to said common signal lines.

13. The printhead according to claim 9, wherein said common signal lines are pulled down, and further comprising diode switches provided between said common signal lines and said AND circuits, and wherein outputs from said diode switches are connected to said common signal lines.

14. The printhead according to claim 13, further comprising a bus terminator connected to an end of each of said common signal lines.

15. The printhead according to claim 9, wherein the number of common signal lines is equal to or more than a maximum number of heat generators simultaneously-driven in the time-division drive, and less than the number of said heat generators.

16. The printhead according to claim 9, wherein said counter is an adder, and wherein said adder adds up outputs from said common signal lines.

17. A printing apparatus which performs printing by using the printhead of claim 9.

18. The printhead according to claim 8, wherein a number of bits in said shift register and the number of said heat generators are the same.

19. The printhead according to claim 1, wherein said modulator performs modulation such that when the number of simultaneously-driven heat generators obtained from counting by said counter is larger, the pulse width of the drive signal is wider, while when the number of simultaneously-driven heat generators obtained from counting by said counter is smaller, the pulse width of the drive signal is narrower.

20. The printhead according to claim 1, wherein said printhead is an ink-jet printhead which performs printing by discharging ink.

21. The printhead according to claim 20, wherein said printhead comprises an electrothermal transducer which generates thermal energy to be applied to the ink, to discharge the ink by utilizing the thermal energy.

22. The printhead according to claim 1, wherein outputs to heat generators which are not simultaneously driven in time-division drive are connected to one of common signal lines, and wherein said common signal lines are connected to said counter.

23. A printing apparatus which performs printing by using the printhead of claim 1.

* * * * *

UNITED STATES PATENT AND TRADEMARK OFFICE

CERTIFICATE OF CORRECTION

PATENT NO. : 6,382,755 B1
DATED : May 7, 2002
INVENTOR(S) : Imanaka et al.

It is certified that error appears in the above-identified patent and that said Letters Patent is hereby corrected as shown below:

Column 6,
Line 15, “Invention,” should read -- invention, --.

Column 7,
Line 22, “embodiment” should read -- embodiments --.

Column 13,
Line 19, “control” should read -- control operations --.
Line 41, “connected” should read -- connected to --.

Column 15,
Line 37, “rinthead,” should read -- printhead, --.

Column 17,
Line 5, “claim 3,” should read -- claim 6, --.

Signed and Sealed this

Twenty-fourth Day of December, 2002

JAMES E. ROGAN
*Director of the United States Patent and Trademark Office*